US008387808B2

(12) United States Patent
Radowski

(10) Patent No.: US 8,387,808 B2
(45) Date of Patent: Mar. 5, 2013

(54) GARMENT HANGER MANAGEMENT DEVICE

(75) Inventor: James A. Radowski, North Muskegon, MI (US)

(73) Assignee: Pipp Mobile Storage Systems, Inc., Walker, MI (US)

( * ) Notice: Subject to any disclaimer, the term of this patent is extended or adjusted under 35 U.S.C. 154(b) by 14 days.

(21) Appl. No.: 12/951,782

(22) Filed: Nov. 22, 2010

(65) Prior Publication Data

US 2011/0120962 A1 May 26, 2011

Related U.S. Application Data

(60) Provisional application No. 61/264,066, filed on Nov. 24, 2009.

(51) Int. Cl.
*A47H 1/00* (2006.01)
*E05B 73/00* (2006.01)

(52) U.S. Cl. ..... 211/123; 211/7

(58) Field of Classification Search .... 211/105.1–105.6, 211/123, 124, 7, 8; 248/251, 261, 266; 403/322.4, 403/325, 326; 292/1, 251, 194, 219, 226, 292/200; 70/58–62
See application file for complete search history.

(56) References Cited

U.S. PATENT DOCUMENTS

| | | | | |
|---|---|---|---|---|
| 1,793,036 | A | 2/1931 | Whitney | |
| 3,084,802 | A * | 4/1963 | Ittner | 211/4 |
| 3,254,774 | A * | 6/1966 | Schild | 211/182 |
| 3,399,783 | A * | 9/1968 | Injeski | 211/103 |
| 3,419,154 | A * | 12/1968 | Shapiro et al. | 211/7 |
| 3,441,147 | A * | 4/1969 | Kelley | 211/113 |
| 3,567,034 | A * | 3/1971 | Mozelsio | 211/7 |
| 3,610,423 | A | 10/1971 | Parillo | |
| 3,659,721 | A | 5/1972 | Parillo | |
| 3,735,875 | A * | 5/1973 | Parillo | 211/7 |
| 4,037,728 | A * | 7/1977 | Cameron | 211/124 |
| 4,139,102 | A * | 2/1979 | Winton | 211/124 |
| 4,340,145 | A | 7/1982 | Cameron | |
| 4,735,534 | A | 4/1988 | Oehlke | |
| 4,753,355 | A | 6/1988 | Hall et al. | |
| 4,887,727 | A | 12/1989 | Simmerman et al. | |
| 5,018,627 | A * | 5/1991 | Moore | 211/123 |
| 5,076,446 | A | 12/1991 | Simmerman et al. | |
| 5,088,853 | A * | 2/1992 | Reid | 403/330 |
| 5,092,473 | A | 3/1992 | Zelniker | |
| 5,139,298 | A * | 8/1992 | Dowell | 294/145 |

(Continued)

FOREIGN PATENT DOCUMENTS

| | | |
|---|---|---|
| DE | 176150 | 9/1953 |
| DE | 1299385 | 7/1969 |

(Continued)

*Primary Examiner* — Darnell Jayne
*Assistant Examiner* — Kimberley S Wright
(74) *Attorney, Agent, or Firm* — Gardner, Linn, Burkhart & Flory, LLP

(57) ABSTRACT

A garment hanger management device provides convenient, secure, and organized storage for garment hangers, including garment hangers having various sizes of hook portions, such as for use in a retail clothing environment. The device includes locking mechanisms with movable pins or mounting members that support a retainer element in spaced arrangement relative to a hanger support rod on which the garment hangers are hung. The pins and retainer element are positionable between a fully open configuration and a fully closed configuration, or substantially any position in between the fully opened or closed configurations, and are lockable or fixable in a desired configuration by a locking tab that is capable of engaging the pins substantially anywhere within a region along the length of the pins.

34 Claims, 14 Drawing Sheets

U.S. PATENT DOCUMENTS

| | | | | |
|---|---|---|---|---|
| 5,186,341 | A * | 2/1993 | Zeid | 211/204 |
| 5,251,767 | A | 10/1993 | Wiederer | |
| 5,509,542 | A | 4/1996 | Simmerman et al. | |
| 5,542,633 | A * | 8/1996 | Nagel | 248/214 |
| 5,683,195 | A | 11/1997 | Liao | |
| 6,223,915 | B1 | 5/2001 | Waner | |
| 6,622,979 | B2 * | 9/2003 | Valiulis | 248/220.42 |
| D553,476 | S | 10/2007 | Waner et al. | |
| 2003/0111435 | A1 * | 6/2003 | Chen | 211/123 |

FOREIGN PATENT DOCUMENTS

| | | | |
|---|---|---|---|
| DE | 43 27 381 | A1 | 2/1995 |
| GB | 894811 | | 4/1962 |
| GB | 2044094 | A | 10/1980 |
| GB | 2033741 | A | 5/1990 |

* cited by examiner

GARMENT HANGER MANAGEMENT DEVICE

CROSS REFERENCE TO RELATED APPLICATION

The present application claims the benefit of U.S. provisional application Ser. No. 61/264,066, filed Nov. 24, 2009, which is hereby incorporated herein by reference in its entirety.

FIELD OF THE INVENTION

The present invention relates generally to devices for supporting garment hangers, and in particular, to devices for temporarily storing a plurality of garment hangers in a retail environment.

BACKGROUND OF THE INVENTION

In certain environments, such as retail clothing stores and the like, a large number of garment hangers often circulate between retail sales racks, where the garment hangers support garments, a cash register or point-of-sale area where sold garments are removed from their garment hangers, and a back room or staging area where empty garment hangers are reused by hanging new garments on them and returning them to the retail garment racks. Because garment hangers are prone to entanglement with one another, it is generally desirable to support a plurality of empty garment hangers in an organized fashion to keep the garment hangers ready for reuse.

SUMMARY OF THE INVENTION

The garment hanger management device of the present invention provides for organized storage of a plurality of conventional garment hangers, each having a garment support and a hook attached to the garment support, and adapted to suspend the hanger from a support. The garment hanger management device is positionable between an open configuration in which garment hangers may be positioned on the device or removed from the device, and a closed configuration in which the garment hangers are substantially precluded from removal from the device. The garment hanger management device includes a hanger support rod for supporting the garment hangers by their hook portions, and further includes a retainer element that is generally parallel to the hanger support rod, and which is positionable between the open configuration in which it is spaced from the hanger support rod, and the closed configuration in which it is adjacent or in close proximity to the hanger support rod. The retainer element is movably coupled to the hanger support rod by a pair of movable mounting members or pins that are selectively engaged by a locking tab. The locking tab is capable of engaging the mounting pins substantially anywhere along the pins within a certain range, so that the retainer element can be fixed substantially anywhere between the closed configuration and the open configuration, which permits the device to accommodate a variety of garment hangers having larger or smaller hook portions. Biasing members urge the retainer element toward the open configuration, and also bias the locking tabs into locking engagement with the mounting pins. Thus, when the retainer element is in the open configuration, it may be manually moved toward the fully closed configuration, and held in a fully or partially closed configuration by the locking tabs engaging the mounting pins. The retainer element may be repositioned at the fully open configuration simply by depressing the locking tabs to disengage them from the mounting pins, after which the biasing members move the retainer element to the open configuration.

According to one form of the present invention, a garment hanger management device includes a hanger support rod, an elongate retainer element, at least one movable mounting member, a biasing member, and a locking tab. The hanger support rod is configured to support a plurality of garment hangers at their hook portions, and may be hollow or solid and of substantially any shape, including cylindrical, polygonal, and the like. The retainer element is positionable between an open configuration and at least one closed configuration. In the open configuration, the retainer element is spaced from the hanger support rod to permit placement and removal of the garment hangers from the hanger support rod. In the closed configuration, the retainer element is positioned adjacent or in closer proximity to the hanger support rod to prevent the garment hangers from being removed from the hanger support rod. The hanger support rod has opposite end portions, at least one of which supports the movable mounting member in a transverse orientation (i.e., substantially perpendicular to the longitudinal axis of the hanger support rod) such that the mounting member is movable in a transverse direction. The biasing member, which may be a coil spring or the like, is positioned between a portion of the movable mounting member and a portion of the hanger support rod. The biasing member urges the retainer element and an end portion of the movable mounting member in a transverse direction outwardly away from the hanger support rod. The locking tab is pivotally coupled to at least one of the opposite end portions of the hanger support rod and defines an aperture for receiving the movable mounting member. The locking tab engages the movable mounting member when the locking tab is in a first pivotal orientation, and disengages the movable mounting member when the locking tab is in a second pivotal orientation. When the locking tab is in its first pivotal orientation, it substantially prevents the movable member from moving toward the open configuration.

In one aspect, the locking tab is capable of engaging the movable mounting member at three or more different positions along the movable mounting member. Optionally, the locking tab can engage the movable mounting member at a substantially unlimited number of locations along the movable mounting member.

In another aspect, the movable mounting member comprises a generally cylindrical pin. Optionally, the aperture in the locking tab is a generally circular hole for receiving the cylindrical pin, where the cylindrical hole has a diameter that is at least slightly greater than that of the cylindrical pin. The cylindrical pin moves substantially unimpeded through the circular hole when the locking tab is in the first pivotal orientation, and the locking tab impinges on the cylindrical pin to impede movement of the cylindrical pin through the circular hole when the locking tab is in the second pivotal orientation.

In yet another aspect, the hanger support rod is hollow tubular member with at least one transverse aperture for receiving the movable mounting member. Optionally, the hanger support rod further comprises a guide housing that is spaced radially outwardly from the hanger support rod near at least one transverse aperture. A surface of the guide housing defines a housing transverse aperture that is aligned with the transverse aperture of the hollow tubular member, with the apertures receiving the movable mounting member.

In still another aspect, the locking tab is disposed between the guide housing and the hanger support rod. The aperture of the locking tab is aligned with the transverse aperture of the hanger support rod, and also with the housing transverse aperture in the surface of the guide housing. Optionally, a second biasing member is disposed between the locking tab and an outer surface of the hanger support rod, the second biasing member urging the locking tab into the first pivotal orientation.

In a further aspect, the movable mounting member, biasing members, locking tab, and guide housing are assembled to form an end cap assembly that is coupled to at least one of the opposite end portions of the hanger support rod. Optionally, the garment hanger management device includes movable mounting members, biasing members, locking tabs, and/or end cap assemblies at both opposite end portions of the hanger support rod for supporting the retainer element between the open and closed configurations.

When end cap assemblies are provided, they may include male extension portions for insertion into the hollow end of a tubular hanger support rod, or may include sleeve portions for insertion of the hanger support rod into the end cap assemblies.

Optionally, each end cap assembly includes a main body and an insert. The main body defines a passageway that receives the insert. An opening may be defined between a portion of the insert and a portion of one of the end portions of the hanger support rod, with a portion of the locking tab extending through the opening.

Thus, the present invention provides a garment hanger management device that securely stores a plurality of garment hangers in an organized fashion regardless of the size(s) of the hook portions of the garment hangers. A retainer element, which holds the hook portions of the garment hangers against the hanger support rod, may be positioned in a closed configuration simply by manually urging the retainer element toward the hanger support rod, and may be released to the open configuration simply by depressing the locking tabs at either end of the hanger support rod. The retainer element may be positioned substantially anywhere between the open configuration and the closed configuration by manually moving the retainer element to the desired position where it is held by engagement of the locking tabs with the movable mounting members.

These and other objects, advantages, purposes, and features of the present invention will become apparent upon review of the following specification in conjunction with the drawings.

DESCRIPTION OF THE PREFERRED EMBODIMENTS

The present invention is directed to a garment hanger management device that is capable of securely storing a plurality of garment hangers by retaining the hook portions of the hangers along a hanger support rod. The device is well suited to support conventional garment hangers of the type having a garment-supporting portion and a hook portion attached to the garment support, and adapted to suspend the hanger from a support rod or bar. The hook portions of the garment hangers are retained against the support rod by a retainer element that is positionable and fixedly held in a fully-open configuration, a fully-closed configuration, or substantially anywhere in between (i.e. partially closed), whereby the garment hangers are securely held by their hook portions to the hanger support rod by the retainer element when the retainer element is in a fully or partially closed configuration. Locking tabs permit the retainer element to be readily released and moved to the open configuration to permit removal of the garment hangers from the hanger support rod, and also permit the retainer element to be positioned at substantially any partially-closed position, such as to accommodate garment hangers having different sizes of hook portions, as will be more fully described below.

Figure 1:
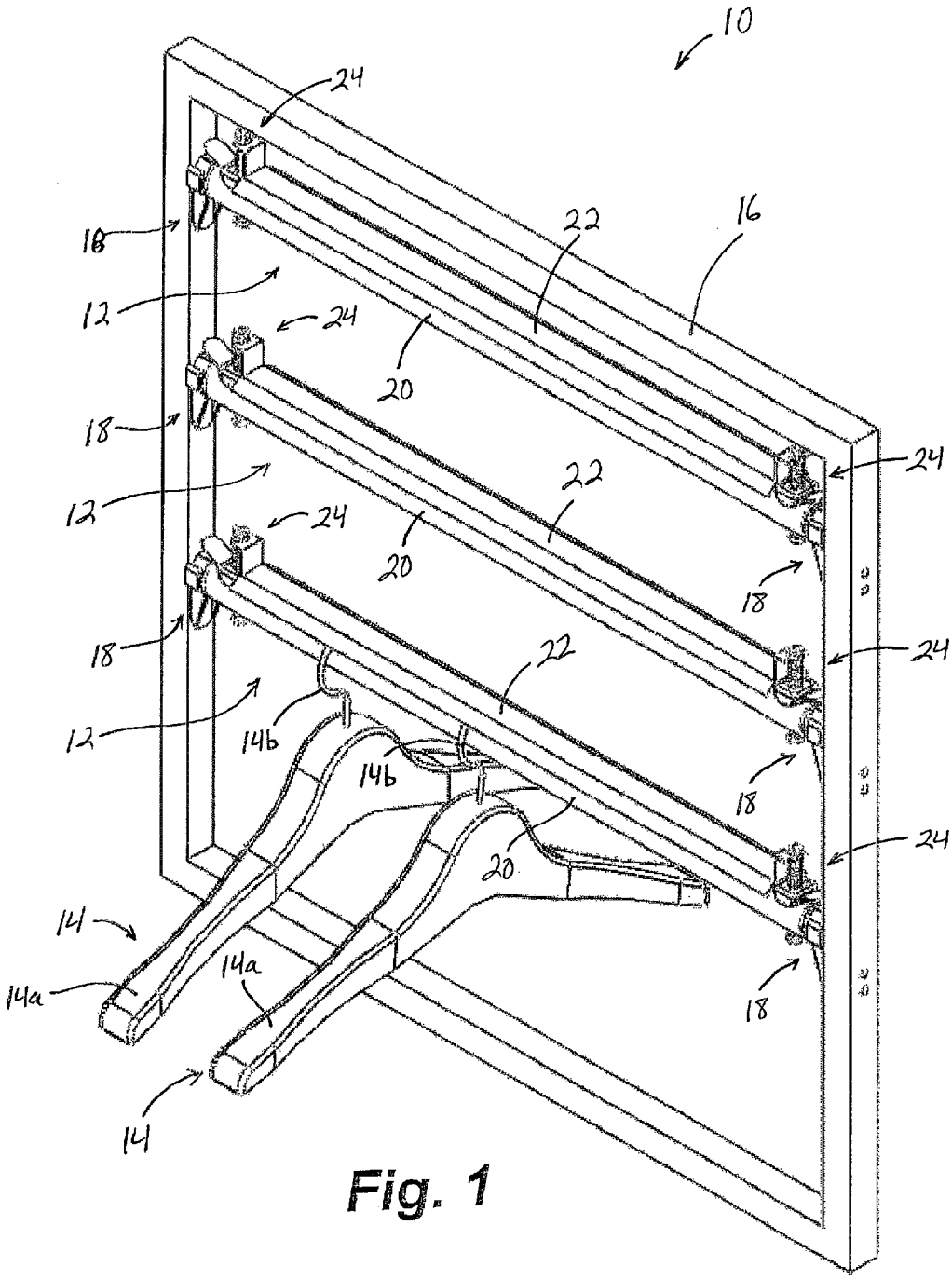
FIG. 1 is a perspective view of a garment hanger management system including garment hanger management devices in accordance with the present invention.

Referring now to FIG. 1, the garment management system 10 includes a plurality of garment hanger management or storage devices 12 for supporting a plurality of garment hangers 14. In the illustrated embodiment, the garment hanger management system 10 includes a framework 16 having a plurality of brackets 18 disposed along inner surfaces of framework 16 for supporting garment hanger management devices 12. Each garment hanger 14 includes a garment-supporting portion 14*a* and a hook portion 14*b*. Each garment hanger management device 12 includes an elongate hanger support rod 20 for supporting the garment hangers 14 by their hook portions 14*b*, and a movable elongate retainer element 22 for securing the hook portions 14*b* to and against the hanger support rod 20. A locking mechanism 24 at each end of hanger support rod 20 couples the retainer element 22 to the hanger support rod 20 and permits retainer element 22 to be positioned at or between a fully open configuration and a fully closed configuration. Framework 16 is transportable, and may be fitted with wheels and/or incorporated into a transportable unit such as an under-counter storage unit for use in cash register or point-of-sale areas to facilitate storing and moving a large number of garment hangers.

Figure 2:
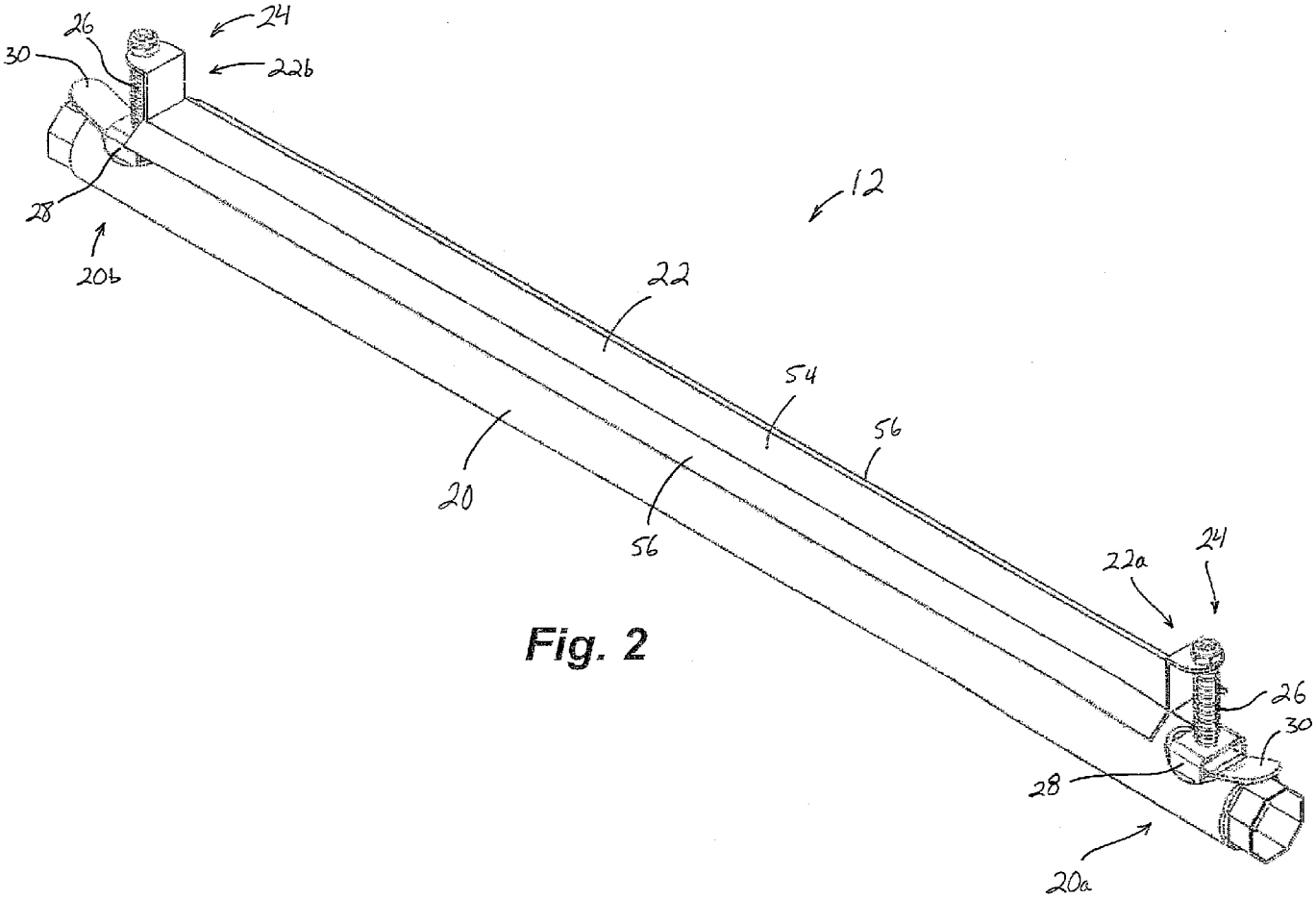
FIG. 2 is a perspective view of a garment hanger management device.
Figure 3:
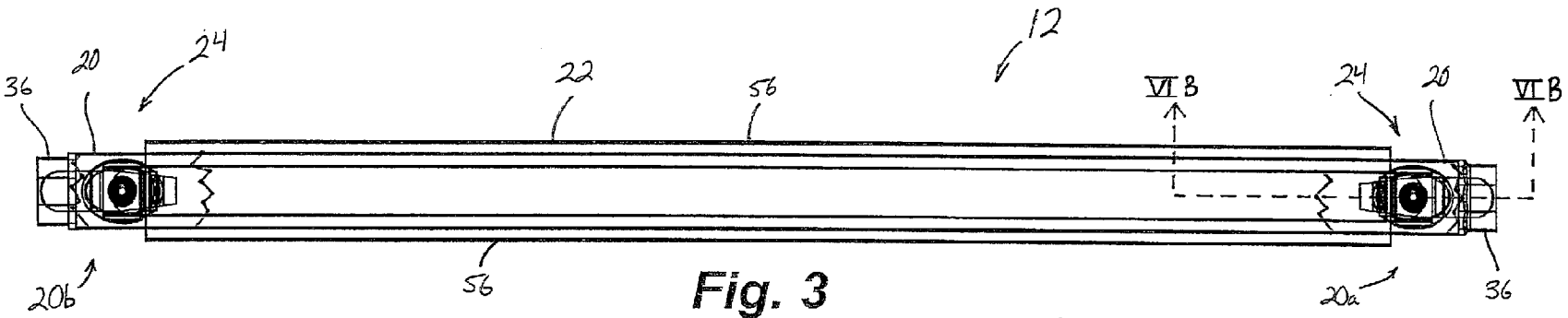
FIG. 3 is a top plan view of the garment hanger management device of FIG. 2, with portions broken away.
Figure 4:
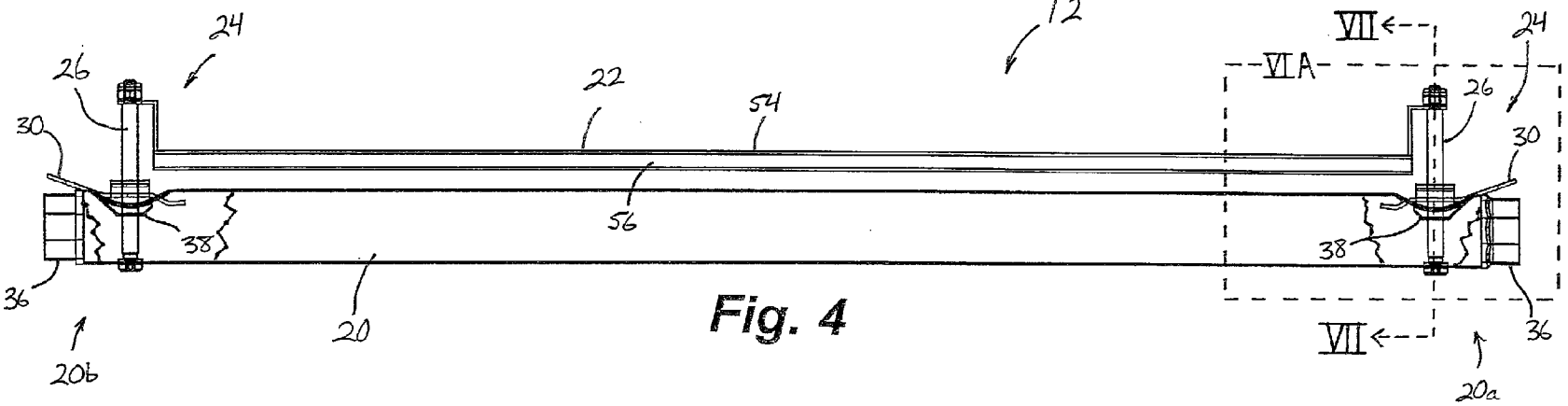
FIG. 4 is a side elevation of the garment hanger management device of FIG. 2, with portions broken away.

Hanger support rod 20 of garment hanger management device 12 has opposite end portions 20*a*, 20*b* with locking mechanisms 24 (FIG. 2). Retainer element 22 has opposite end portions 22*a*, 22*b* corresponding to the opposite end portions 20*a*, 20*b* of hanger support rod 20. Retainer element 22 is movably coupled to hanger support rod 20 at opposite end portions 22*a*, 22*b*, which are supported on movable mounting members, such as movable shoulder bolts or studs or pins 26, which are oriented transversely to the longitudinal axis of hanger support rod 20, and which project radially outwardly from and transversely to the longitudinal axis of the hanger support rod 20. In addition to movable pins 26, locking mechanisms 24 include a guide housing 28, a locking tab 30 for selectively engaging pins 26, a first biasing member 32 for urging retainer element 22 away from hanger support rod 20, and a second biasing member 34 for biasing the locking tab 30 into a first pivotal orientation (FIG. 5B).

Figure 7:
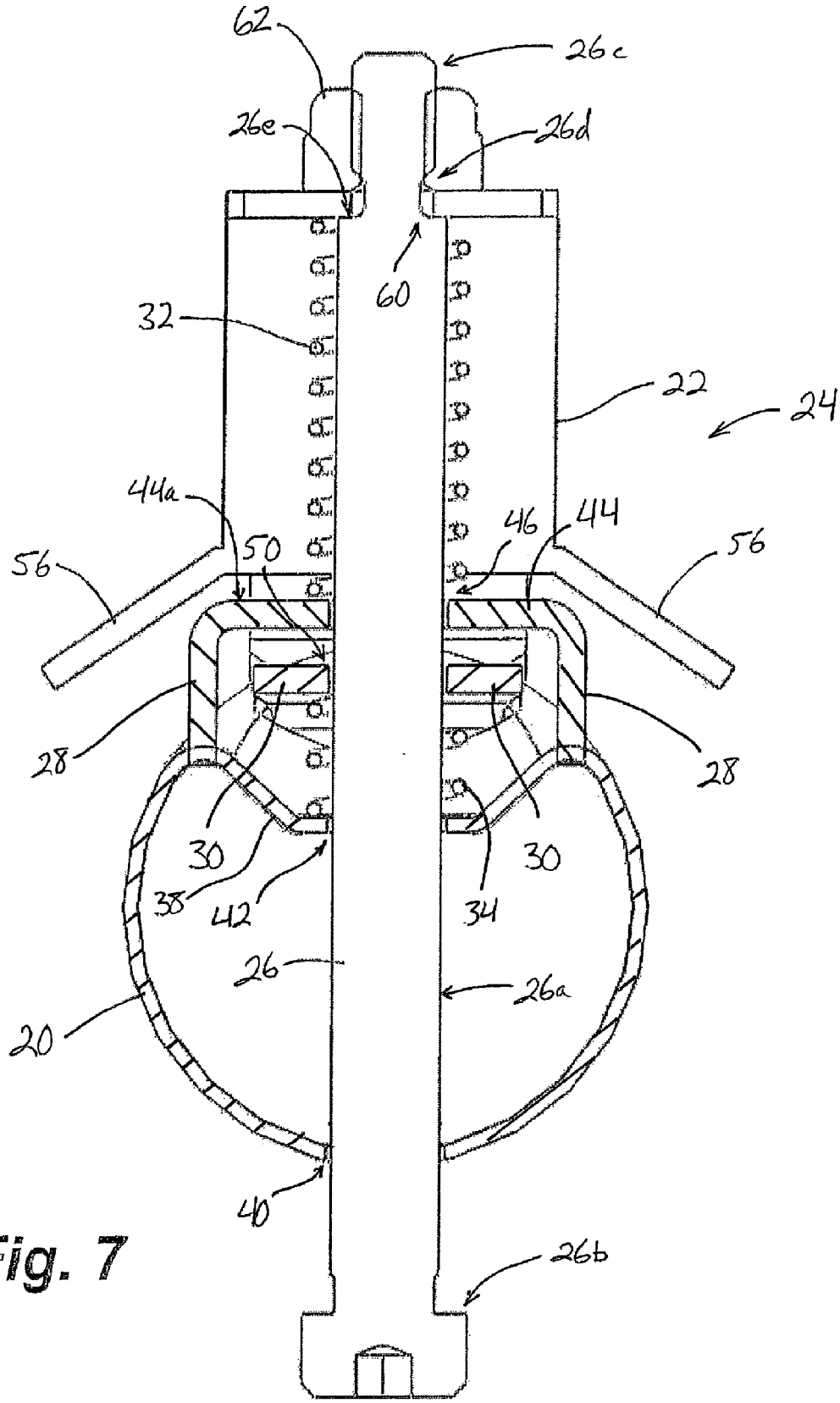
FIG. 7 is a sectional end view taken along section line VII-VII in FIG. 4.
Figure 8A:
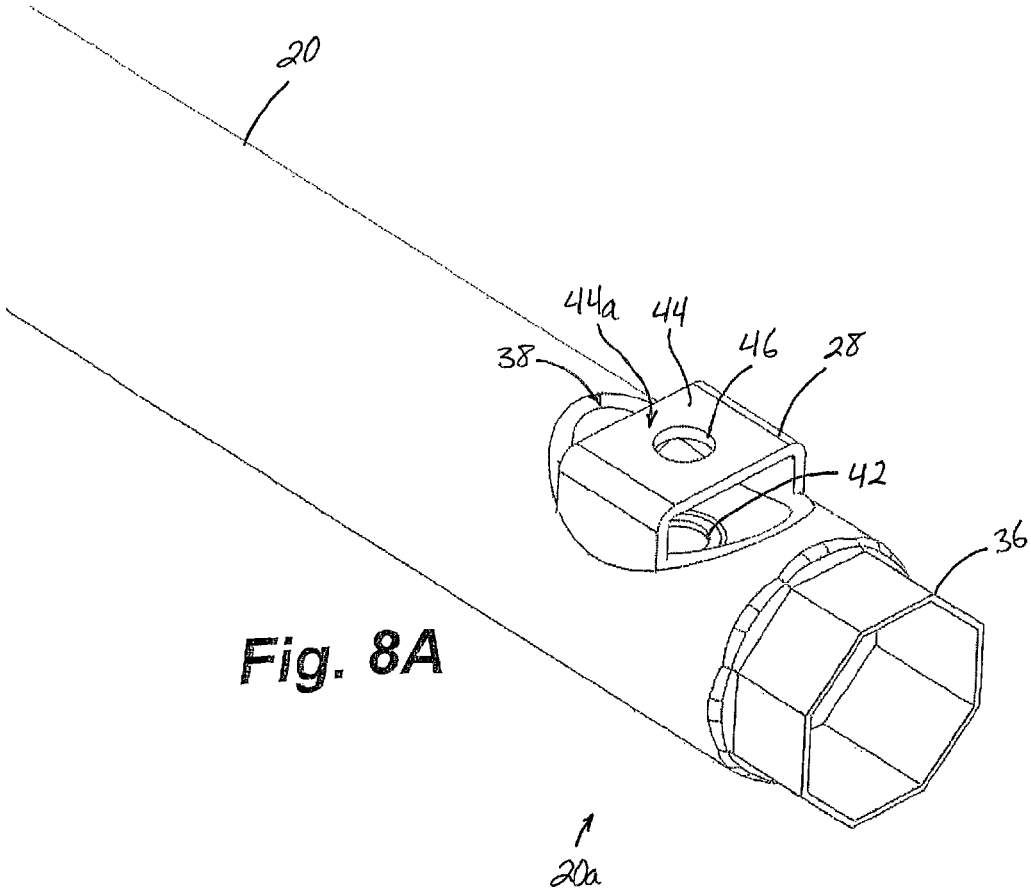
FIG. 8A is a perspective view of an end portion of the hanger support rod of FIG. 2.
Figure 8B:
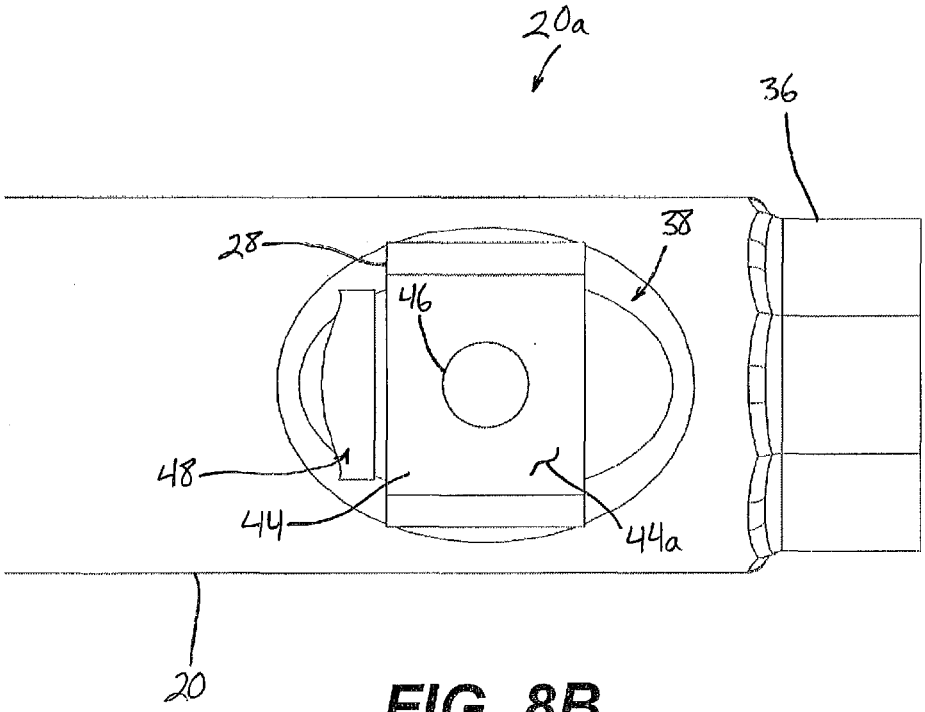
FIG. 8B is a top plan view of the end portion of the hanger support rod of FIG. 8A.

In the illustrated embodiment, hanger support rod 20 is a generally hollow cylindrical member having octagonal ends 36 and a recess or depression 38 formed at each opposite end portion 20*a*, 20*b* in the sidewall of hanger support rod 20, spaced inwardly from octagonal ends 36. Hanger support rod 20 further includes first transverse apertures 40 in the sidewall of the hanger support rod (opposite or across from depressions 38) and second transverse apertures 42 in each depression 38 across from and aligned with first transverse apertures 40. As best shown in FIG. 8, guide housing 28 is formed generally in the shape of a bridge or an inverted-U, coupled at its ends to the surface of hanger support rod 20 on opposite sides of each depression 38. Guide housing 28 includes a generally planar portion 44 that is spaced outwardly from the surface of hanger support rod 20 at depression 38, the planar portion 44 defining a third or housing transverse aperture 46 spaced from second transverse aperture 42 of depression 38 and aligned so that all three of the transverse apertures 40, 42, 46 are in general alignment with one another (FIGS. 5B, 6B, and 7). A pivot aperture 48 at depression 38 receives one end portion 30*a* of locking tab 30 (FIGS. 9A and 9B) and is spaced inboard of second transverse aperture 42 (i.e. toward the center of support rod 20) along an angled or slanted wall portion 38*a* of depression 38 (FIGS. 5B, 6B, and 8B).

Octagonal formed ends 36 of hanger support rod 20 provide an anti-rotation feature to maintain the device 12 in an upright position when supported between brackets 18 of management system 10. In the illustrated embodiment, hanger support rod 20 is formed from a hollow cylindrical metal tube, such as aluminum or steel tubing, whose ends are die-formed or swaged to an octagonal shape, although substantially any non-circular shape could be used. Optionally, the end portions may be machined or molded or otherwise formed to their final desired shape. It will further be appreciated that other materials (such as polymeric and/or fiber-reinforced materials or the like) may be well-suited for use in the hanger support rod 20, and may be molded or readily formed to the final desired shape.

Brackets 18 (FIG. 1) have correspondingly-shaped sockets or receiving portions with open top portions to permit the formed ends 36 of hanger support rod 20 to be placed into the brackets 18 (and removed from the brackets) from above. With the non-circular outer surfaces of formed ends 36 engaging the non-circular outer surfaces of brackets 18, garment hanger management device 12 is prevented from rotating about the longitudinal axis of support rod 20. It will be appreciated that other anti-rotation features, such as detents or locking pins or other devices may be used to limit or prevent rotation of the garment hanger management device when supported in brackets or the like. By limiting or preventing the rotation of garment hanger management device 12, the device may be easier to use and more effective at securely holding garment hangers 14 due to the centering or stabilizing effect of gravity acting upon the hangers 14. Optionally, the garment hanger management device may be held in a fixed orientation by friction or releasable fasteners, or may instead be permitted to rotate by at least a limited amount, without departing from the spirit and scope of the present invention.

Figure 9A:
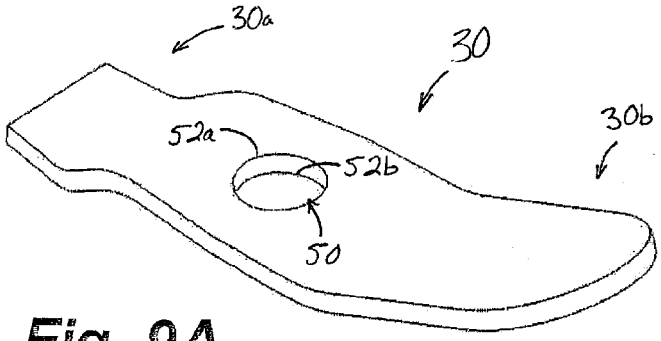
FIG. 9A is a perspective view of the locking tab of the garment hanger management device.
Figure 9B:
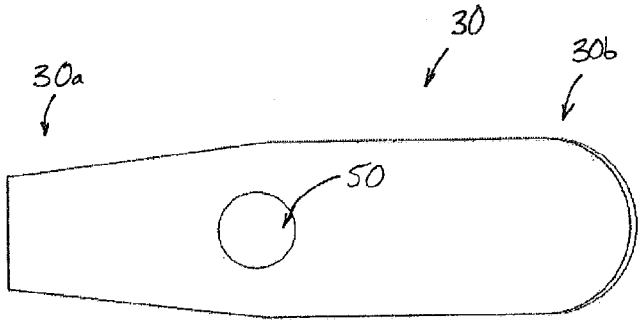
FIG. 9B is a top plan view of the locking tab of FIG. 9A.
Figure 10A:
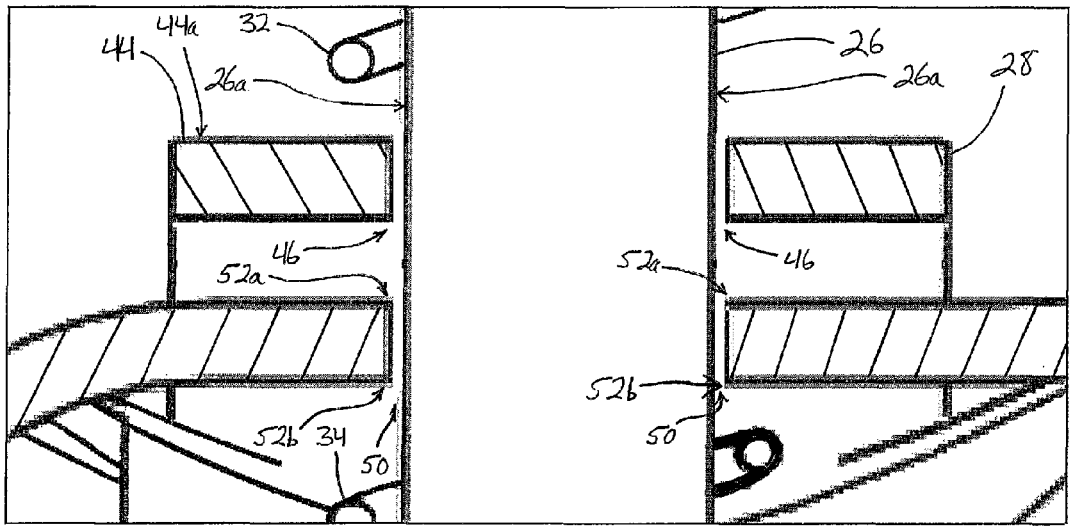
FIG. 10A is an enlarged side elevation of the area designated XA in FIG. 6B with the locking tab in the depressed, disengaged position.
Figure 10B:
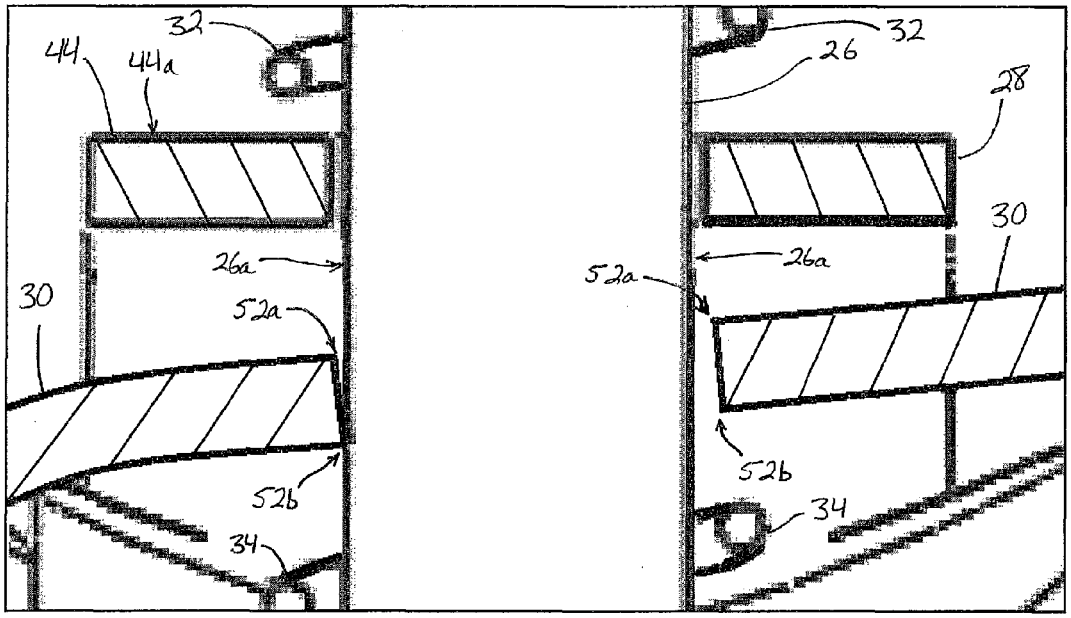
FIG. 10B is an enlarged side elevation of the area designated XB in FIG. 5B with the locking tab in the engaged position.

Locking tab 30 includes a proximal end portion 30*a*, a distal end portion 30*b*, and a fourth transverse aperture 50 positioned between the proximal and distal end portions 30*a*, 30*b* (FIGS. 5B, 6B, 9A, and 9B). Fourth transverse aperture 50 of locking tab 30 is defined by a top edge 52*a* and a bottom edge 52*b* (FIGS. 9A, 10A, and 10B). In the illustrated embodiment, top edge 52*a* and bottom edge 52*b* are generally circular in shape, and the diameter of fourth transverse aperture 50 is at least slightly greater than that of movable pins 26. Proximal end portion 30*a* of locking tab 30 is narrower than distal end portion 30*b*, and is sized so as to be insertable into pivot aperture 48 (FIGS. 5B and 6B). Distal end portion 30*b* provides a surface for manual actuation of locking tab 30 as it extends away from guide housing 28 and hanger support rod 20. When locking tab 30 is assembled to hanger support rod 20, proximal end portion 30*a* is inserted through pivot aperture 48 and into the interior of hanger support rod 20, while fourth transverse aperture 50 of locking tab 30 is arranged between third transverse aperture 46 of guide housing 28 and second transverse aperture 42 of depression 38 in hanger support rod 20. Locking tab 30 is pivotable between a first pivotal orientation or locking orientation (FIGS. 5A, 5B, and 10B) and a second pivotal orientation or an unlocking orientation (FIGS. 6A, 6B, and 10A) as will be described below.

Movable pins 26 include generally cylindrical center portions 26*a*, a head or flange 26*b* at one end, and a threaded stud portion 26*c* at an opposite end. Head 26*b* is positioned radially outwardly of hanger support rod 20 (i.e. opposite from guide housing 28) at first transverse aperture 40 (FIGS. 5A-7), and has a larger diameter than first transverse aperture 40 to prevent passage of head 26*b* through the aperture 40. Cylindrical center portion 26*a* of movable pin 26 has a slightly smaller diameter than transverse apertures 40, 42, 46, where each of these apertures is aligned to receive and support cylindrical center portion 26*a* of movable pin 26 in a movable or slidable fashion. Fourth transverse aperture 50 of locking tab 30 is also at least slightly larger than the diameter of cylindrical center portion 26*a* of movable pin 26, and may be of generally the same or a slightly larger diameter than the diameter(s) of first, second, and third transverse apertures 40, 42, 46. Threaded stud portion 26*c* of movable pin 26 has a diameter that is at least slightly less than that of cylindrical center portion 26*a* to permit threaded stud portion 26*c* to readily pass through the transverse apertures during assembly of locking mechanism 24 and to receive retainer element 22. Preferably, a neck region 26*d* between threaded stud portion 26*c* and cylindrical center portion 26*a* provides a shoulder 26*e* for supporting a portion of retainer element 22 (FIGS. 5B, 6B, and 7), as will be described below.

In the illustrated embodiment, movable pins 26 are unitarily formed, such as from a machined casting or from machined or formed cylindrical bar or wire stock. However, it will be appreciated that other types of movable pins or mounting members, and even conventional threaded or partially-threaded bolts, could be used without departing from the spirit and scope of the present invention. For example, the pins may have any substantially constant cross sectional shape, such as circular, square or other polygon, oval, etc. The pins may also be made of two or three or more components, such as a generally cylindrical member corresponding to cylindrical center portion 26*a*, having threaded bores formed axially in either end for receiving threaded screws or bolts corresponding to head 26*b* and stud portion 26*c*. In addition, other pin shapes or configurations are envisioned, such as shortened pins that do not protrude though the hanger support rod at a location corresponding to first transverse aperture 40, but which instead terminate with heads or flanges positioned inside of the hanger support rod so that the pins are supported solely at apertures corresponding to apertures 42, 46, 50.

Lock members 30 and movable pins 26 are made of any sufficiently strong, hard, and wear-resistant materials, such as steel or aluminum alloy, for example. The surface texture of pins 26 at cylindrical center portion 26*a* is generally smooth but not overly polished, although rougher surfaces are acceptable and generally only affect the pins' resistance to sliding while in contact with lock members 30. Lock members 30 are sufficiently hard to maintain a degree of sharpness of lower edges 52*b* while the edges are in sliding contact with pins 26. Because lower edges 52*b* of lock members 30 impinge on pins 26 to limit or prevent the pins from moving, it may be advantageous to use materials (e.g. metals) of generally equal hardness for both the lock members 30 and the pins 26 so that the lock members 30 do not gouge or overly polish the cylindrical center portion 26*a* of pins 26, and so that the pins 26 do not excessively wear or round-off the edges 52*b* of lock members 30.

As best shown in FIGS. 5B, 6B, and 7, first biasing member 32 is positioned between an upper surface 44*a* of generally planar portion 44 of guide housing 28 and shoulder portion 26*e* of movable pin 26. In the illustrated embodiment, first biasing member 32 is a coil spring that is disposed around, telescoped over, and generally co-axial with cylindrical center portion 26*a* of movable pin 26, and is maintained in compression regardless of the position of retainer element 22 relative to hanger support rod 20. First biasing members 32 are sufficiently strong to urge the lower edges 52*b* of lock member 30 into contact with pins 26. Second biasing member 34 is positioned between a lower surface of locking tab 30 in the vicinity of fourth transverse aperture 50, and depression 38 of hanger support rod 20 in the vicinity of second transverse aperture 42. In the illustrated embodiment, second biasing member 34 is a coil spring disposed about, telescoped over, and generally coaxial with cylindrical center portion 26*a* of movable pin 26, and is held in compression regardless of the pivotal orientation of locking tab 30.

Retainer element 22 comprises an elongate member between opposite end portions 22*a*, 22*b*, and is shaped to generally follow the contour of hanger support rod 20 (FIGS. 2 and 7). In the illustrated embodiment, the elongate portion of retainer element 22 includes a generally planar central portion 54 and a pair of generally planar wings 56 extending from either side of the planar central portion 54 and angled downwardly (as viewed in the figures) to generally follow the contour of hanger support rod 20, as best shown in FIGS. 2 and 7. When retainer element 22 is in the closed configuration of FIGS. 1, 5A, and 5B, retainer element 22 secures garment hangers 14 by their hook portions 14*b* against hanger support rod 20, while wing portions 56 of retainer element 22 may additionally limit or substantially prevent excessive swaying of the hangers 14 that could lead to the hook portions 14*b* slipping out from between retainer element 22 and hanger support rod 20 (FIG. 5B).

Each opposite end portion 22*a*, 22*b* of retainer element 22 includes an L-shaped mounting portion 58 extending upwardly from either end of planar central portion 54. The L-shaped mounting portions 58 each have a substantially vertical leg 58*a* extending upwardly from planar central portion 54, and a generally horizontal leg 58*b* extending perpendicularly outwardly from vertical leg 58*a* and generally parallel to and spaced from planar portion 44 of guide housing 28. Horizontal leg 58*b* includes a pin-receiving aperture 60 (FIGS. 5B, 6B, and 7) having the same or larger diameter than threaded stud portion 26*c* of movable pin 26, and having at least slightly smaller diameter than shoulder portion 26*e* so that horizontal leg 58*b* of L-shaped mounted portion 58 is supportable on shoulder portion 26*e*. A threaded fastener 62, such as a threaded locknut or the like, threadedly engages threaded stud portion 26*c* of movable pin 26 so that horizontal leg 58*b* is fixedly secured between threaded fastener 62 and shoulder portion 26*e*. Accordingly, retainer element 22 moves with movable pins 26 relative to hanger support rod 20. Optionally, threaded fastener 62 may be at least partially covered or overmolded with a smooth and/or ergonomic cover or overlay, which improves the appearance of the fastener and which improves the feel to a user who may wish to use his or her thumbs or fingers or palms to press the pins 26 downwardly toward a partially or fully closed configuration.

Retainer element 22 may be unitarily formed from die-cut sheet metal, for example. Retainer element 22 may be at least somewhat resilient and flexible, which permits the retainer element to bow or bend when it is moved to the fully closed or a partially-closed configuration with garment hangers' hook members 14*b* positioned on the hanger support rod 20. This resilience and flexibility may be particularly advantageous, for example, when garment hangers with relatively large-diameter hook members are positioned near the middle of hanger support rod 20, while garment hangers with relatively small-diameter hook members are positioned near one or more of the opposite end portions 20*a*, 20*b* of hanger support rod 20. The retainer element's flexibility permits it to contact and secure substantially all of the garment hanger hook portions when the movable pins are set at the fully (or a partially) closed configuration normally corresponding to only the smaller-diameter hook portions.

Optionally, the retainer element may be bowed when in its relaxed or fully-open state, such as in a concave-up or U-shape, which may help ensure that the retainer element applies even pressure against similarly-sized garment hanger hook members positioned along the length of hanger support rod 20, even when pins 26 are moved or lowered to a fully or partly closed configuration that is lower or tighter than necessary. A concave or U-shaped retainer element may also facilitate retention of differently sized hook members along hanger support rod 20, even when hangers with larger-diameter hook members are positioned near the end portions 20*a*, 20*b* and hangers with smaller-diameter hook members are positioned near the middle.

Accordingly, retainer element 22 may be positioned between a fully closed configuration (FIGS. 1, 5A, 5B, and 7) and a fully open configuration (FIGS. 2-4, 6A, and 6B), or at substantially any position in between the fully open and fully closed configurations. Positioning of the retainer element 22 is accomplished by manually moving the retainer element 22 against the biasing force of first biasing members 32 (such as by applying a force to the tops of pins 26 and/or to the retainer element 22 itself), and by manually moving the locking tabs 30 from their first pivotal or locking orientation (FIGS. 5A and 5B) to their second pivotal or unlocking orientation (FIGS. 6A and 6B) against the biasing force of second biasing member 34. Additionally, retainer element 22 may be moved from the fully open configuration to being locked in substantially any partially or fully closed position without manipulating locking tab 30, as will be described below.

Figure 5A:
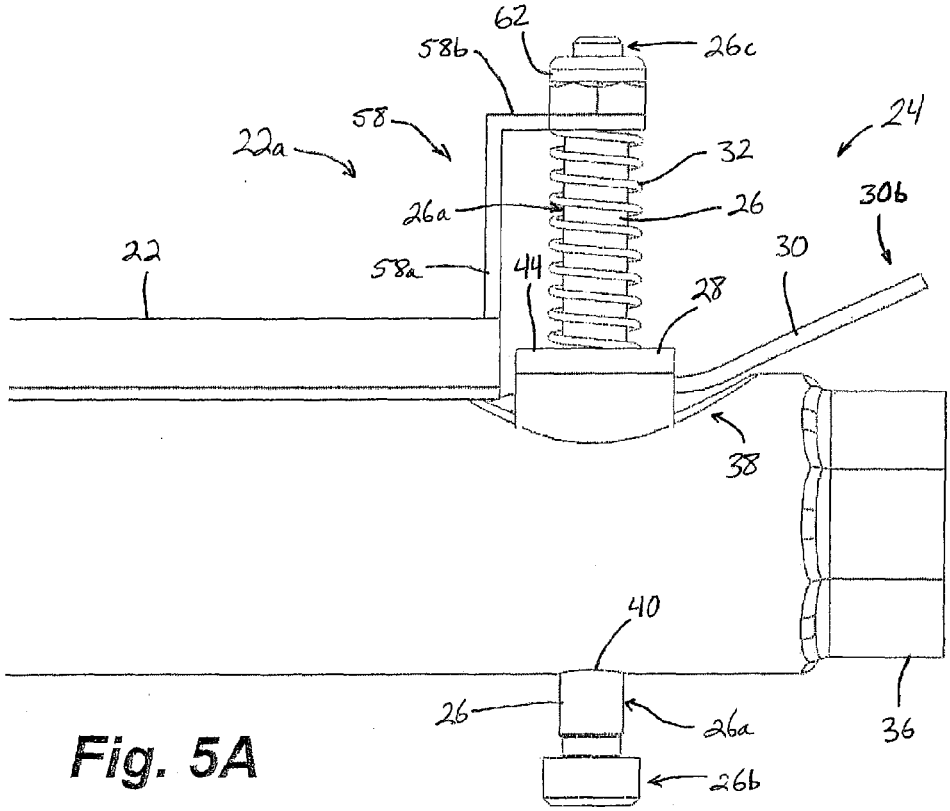
FIG. 5A is a side elevation of an end portion of the garment hanger management device of FIG. 2 with the locking tab in the engaged position.
Figure 5B:
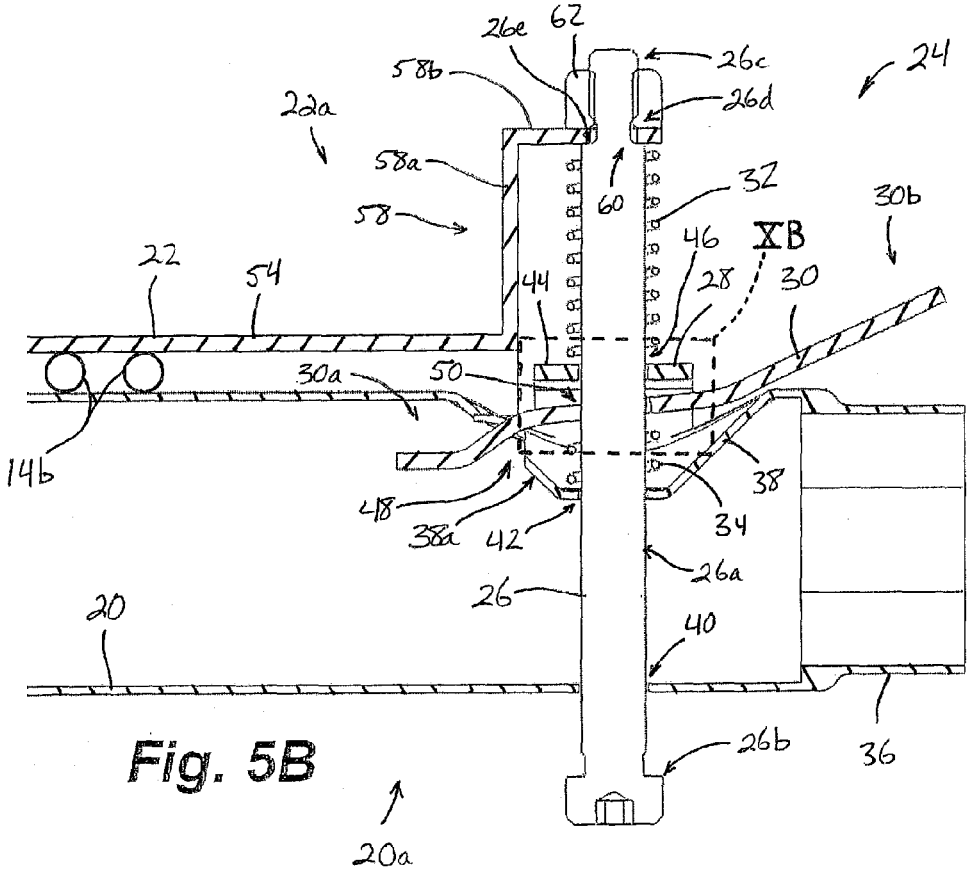
FIG. 5B is a sectional side elevation of the end portion of FIG. 5A.

Referring to FIGS. 5A, 5B and 7, in which retainer element 22 is in the fully closed configuration and locking tab 30 is in the first or locking pivotal orientation, it will be observed that there is sufficient space between planar central portion 54 of retainer element 22 and the sidewall of hanger support rod 20 to secure hook portions 14*b* of garment hangers 14 therebetween (FIG. 5B). Movable pin 26 is in its lowered position with part of cylindrical center portion 26*a* protruding from hanger support rod 20 at first transverse aperture 40 such that head 26*b* is spaced from hanger support rod 20. First biasing member 32 is at its maximum state of compression between horizontal leg 58*b* of L-shaped mounting portion 58, and second biasing member 34 is at its minimum state of compression between the locking tab 30 (in its first or locking pivotal orientation) and depression 38 of hanger support rod 20.

In the first or locking pivotal orientation, locking tab 30 has its transverse aperture 50 at least slightly misaligned with the axis of movable pin 26 so that bottom edge 52*b* of locking tab 30, which defines the lower end of transverse aperture 50, engages or impinges or bites into the surface of cylindrical center portion 26*a* of movable pin 26 (FIG. 10B) along the inboard side of cylindrical center portion 26*a* (i.e., the side facing pivot aperture 48). The impingement of the bottom edge 52*b* of locking tab 30 prevents movable pins 26 from moving to the open configuration. It will be appreciated that, owing to the angle of impingement of bottom edge 52*b* into the surface of cylindrical central portion 26*a* of movable pin 26, when greater biasing force is applied to movable pin 26 by first biasing member 32 (or by the manual application of force), a matching resisting force is applied to pin 26 by locking tab 30 with a correspondingly-increased biting force of the bottom edge 52*b* into the movable pin 26. Although the surface of cylindrical center portion 26*a* of movable pin 26 need not be particularly rough for non-slipping engagement of locking tab 30 with the movable pin, it will be appreciated that a highly polished outer surface of cylindrical center portion 26*a* would be less desirable and potentially more prone to permitting movable pin 26 to inadvertently slip, even when engaged by locking tab 30. Because bottom edge 52*b* of locking tab 30 is capable of engaging and impinging substantially anywhere along the length of the outer surface of cylindrical center portion 26*a* of movable pin 26, it will be appreciated that movable pin 26 and retainer element 22 may be positioned and locked substantially anywhere between the fully open configuration of FIGS. 6A and 6B and the fully closed configuration of FIGS. 5A and 5B.

Optionally, and in order to permit movable pin 26 to be moved from a partially or fully open configuration to the fully closed or a more-closed configuration, without manual actuation of locking tab 30, top edge 52*a* of locking tab 30 should not impinge on cylindrical center portion 26*a* of movable pin 26 when the locking tab 30 in its first or locking configuration (FIGS. 5B and 10B). Thus, when a manual biasing force is applied to retainer element 22 against the biasing force of first biasing member 32, locking tab 30 is permitted to pivot slightly away from its first or locked pivotal orientation against the biasing force of second biasing member 34 so that bottom edge 52*b* is no longer in biting engagement with movable pin 26. Thus, cylindrical center portion 26*a* is permitted to slide along bottom edge 52*b* without top edge 52*a* impinging on the surface of the cylindrical center portion 26*a* of the movable pin 26 when the pin is urged downwardly as shown in the figures. Otherwise, if top edge 52*a* impinges on the outer surface of cylindrical center portion 26*a* of movable pin 26, any force applied to retainer element 22 in the direction of the fully closed configuration would be met with an equal resisting force by the top edge 52*a* of locking tab 30 to prevent movement of movable pin 26.

Figure 6A:
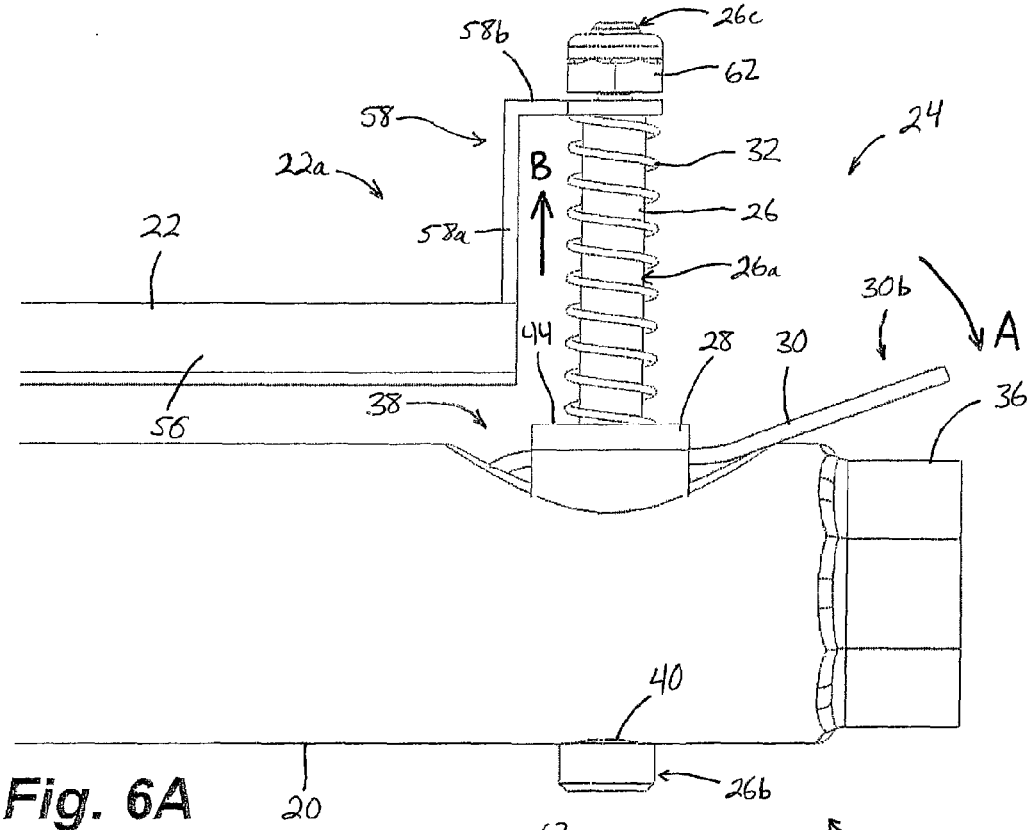
FIG. 6A is a side elevation of the area designated VIA in FIG. 4 with the locking tab in the depressed, disengaged position.
Figure 6B:
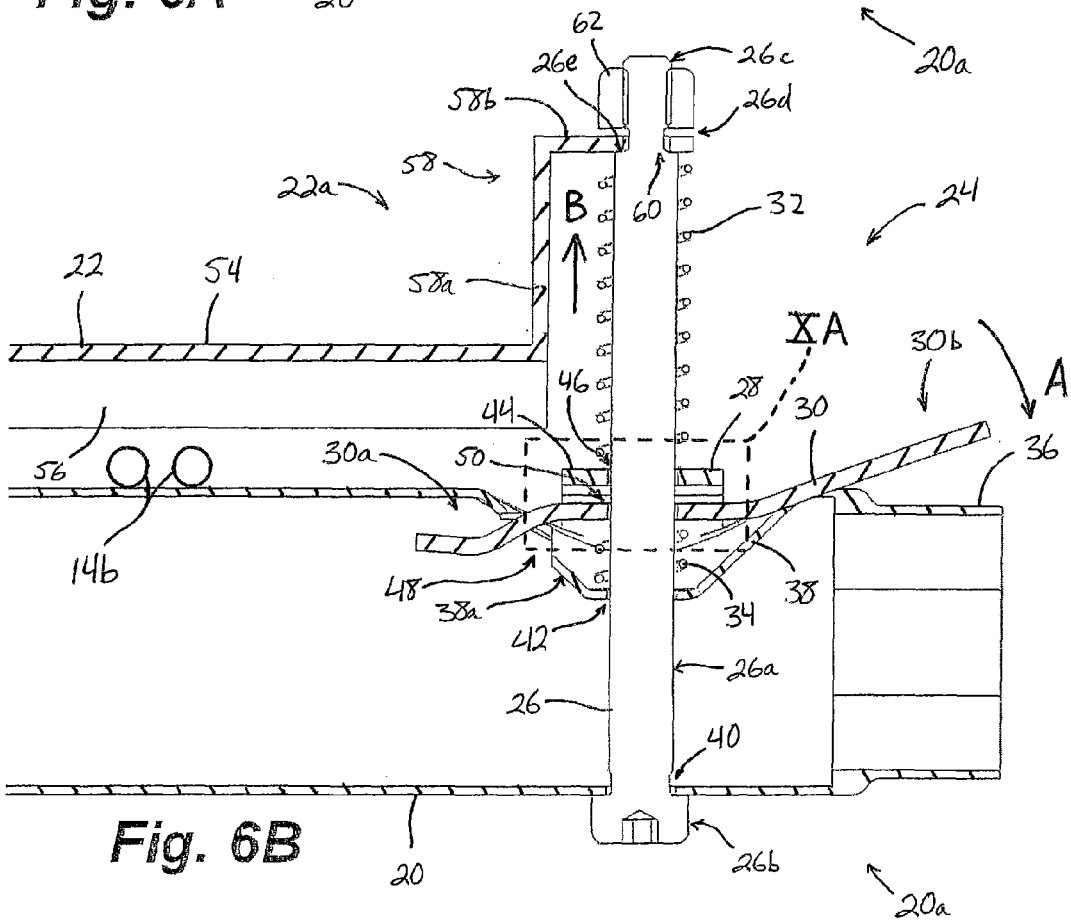
FIG. 6B is a sectional side elevation taken along section line VIB-VIB in FIG. 3 with the locking tab in the depressed, disengaged position.

Referring now to FIGS. 6A and 6B, movable pin 26 and retainer element 22 may be repositioned at the fully open configuration by pivoting locking tab 30 in the direction of curved arrow 'A' to its second or unlocking pivotal orientation so that the top and bottom edges 52*a*, 52*b* defining transverse aperture 50 and locking tab 30 disengage cylindrical center portion 26*a* of movable pin 26 (FIG. 10B) and thus permit the movable pin 26 to slide transversely upwardly in the direction of straight arrow 'B' and away from hanger support rod 20, due to the biasing force of first biasing member 32, until head 26*b* of movable pin 26 contacts hanger support rod 20 in the vicinity of first transverse aperture 40.

Locking tab 30 may be manually pivoted to the second or unlocking pivotal orientation of FIGS. 6A and 6B by applying a force to distal end portion 30*b* in the direction of hanger support rod 20 (as generally indicated by curved arrow 'A'). Locking tab 30 pivots until it reaches the second or unlocking pivotal orientation, at which point a portion of locking tab 30 contacts hanger support rod 20 to limit or substantially prevent further pivoting motion of the locking tab. Because transverse aperture 50 of locking tab 30 is at least slightly larger in diameter than cylindrical center portion 26*a* of movable pin 26, as best shown in FIG. 10A, pin 26 is free to move or slide within all of the aligned transverse apertures 40, 42, 46 and 50 when locking tab 30 is in the second or unlocking pivotal orientation.

Upon the release of force applied to distal end portion 30*b* of locking tab 30, locking tab 30 returns to its first or locking pivotal orientation of FIGS. 5A, 5B and 10B as urged by the force of second biasing member or spring 34. As described above, once locking tab 30 has returned to its first or locking pivotal orientation, retainer element 22 and movable pins 26 are still movable toward the closed configuration without further manipulation of locking tab 30, by simply urging the retainer elements 22 and/or movable pins 26 toward the closed configuration. This counteracts and diminishes the impingement force of bottom edge 52*b* of locking tab 30 so that the movable pin 26 is permitted to slide relative to locking tab 30. Upon release of the force applied to move retainer element 22 and pin 26 toward the closed configuration, first biasing member 32 is free to bias pin 26 slightly outwardly or upwardly again (in the direction of arrow 'B' in FIGS. 5A, 5B, and 10B) to set the bottom edge 52*b* of transverse aperture 50 tightly against cylindrical center portion 26*a* of movable pin 26 with the aid of second biasing member or spring 34 to once again lock the movable pin 26 and retainer element 22 in a fixed position.

Although shown and describe as having a locking mechanism 24 located at (and partially integral with) both opposite end portions 20*a*, 20*b* of hanger support rod 20, other arrangements or configurations are envisioned without departing from the spirit and scope of the present invention. For example, a garment hanger management device may be substantially similar to the device 12 described above, but include only one locking mechanism at one end portion of the hanger support rod for supporting an end of the retainer element, while the opposite end of the retainer element is rigidly or pivotably coupled at or near the opposite end of the hanger support rod. In such an arrangement, the space available between the hanger support rod and the retainer element for positioning hanger hook portions would be relatively large at the end having the locking mechanism in an open configuration, and would be relatively small at the opposite end where the retainer element is rigidly or pivotably coupled. With such an arrangement, hangers with hook portions of substantially any size could be readily placed on the hanger support rod at the open locking mechanism end and then moved or slid along the hanger support rod toward the opposite end before additional hangers are added and the locking mechanism ultimately closed. Such an arrangement would reduce manufacturing cost while having only a relatively minor effect on ease of use, for example.

In another embodiment, a locking mechanism in the form of an end cap assembly 24'

Figure 11:
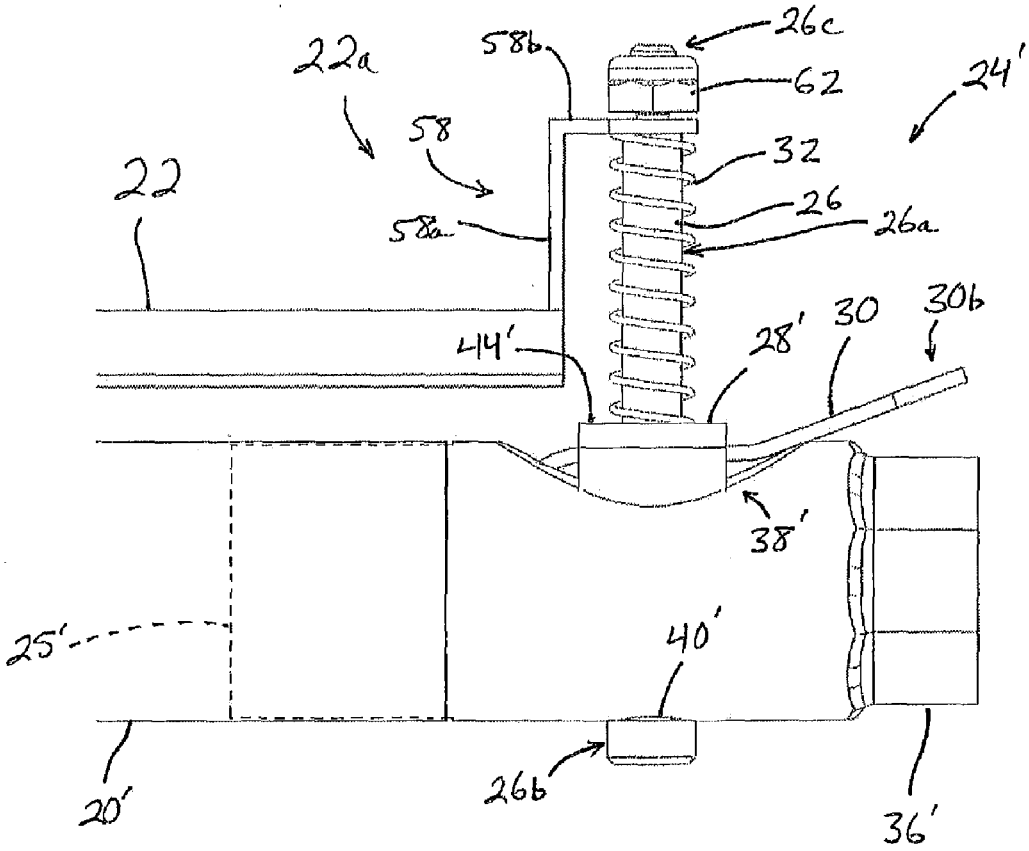
FIG. 11 is a side elevation of an end portion of another garment hanger management device in accordance with the present invention.

(FIG. 11) that is substantially similar to locking mechanism 24 is in the form of separate end pieces or housings, such as plastic housings or the like, that, in addition to having substantially identical components as locking mechanism 24, would also include a coupling feature, such as a male coupler 25' (or, alternately, a female coupler), for inserting into the open end of a tubular hanger support rod 20' (or fitting over the end of a hollow or solid hanger support rod), and could also incorporate an anti-rotation feature 36' similar to the anti-rotation feature 36 described above, and molded or machined on the outer end of the end piece or housing. Male coupler 25' of locking mechanism 24' may include one or more fixing portions (not shown) such as ribs that fit tightly against the inner surface of the hanger support rod 20', or a retaining element that engages a hole or detent in the hanger support rod 20', or is coupled to the rod using mechanical fasteners or adhesives or the like. In the illustrated embodiment of FIG. 11, locking mechanism 24' receives and supports the movable pin 26, the locking tab 30, and the first and second biasing members 32, 34 (second biasing member 34 not shown in FIG. 11) in the same manner as in the locking mechanism 24 that is partially integral with hanger support rod 20. Depression 38' and guide housing 28' are formed or molded with each end piece, especially when the end pieces are molded from polymeric material. Thus, many of the components of the locking mechanism may be incorporated into a single molded component made of plastic or other resinous material, and mated with a respective end of a hanger support rod.

Figure 12:
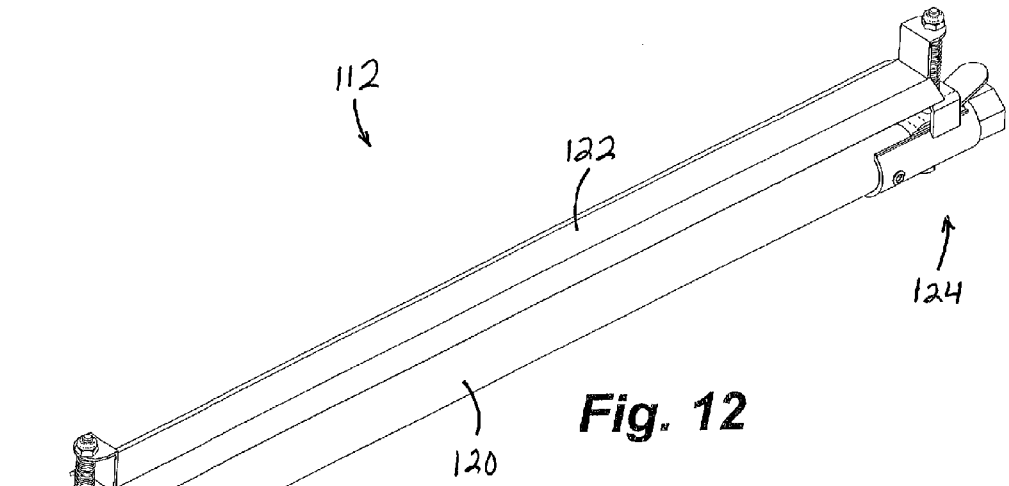
FIG. 12 is a perspective view of another garment hanger device of the present invention.

Optionally, and with reference to FIG. 12, an alternative garment hanger storage or management device 112 includes a hanger support rod 120 and a retainer element 122 that is movably supported by a pair of separate locking mechanisms in the form of end cap assemblies 124 at opposite ends of support rod 120. End cap assemblies 124 comprise female couplers that receive the opposite end portions of support rod 120, and are functionally similar or substantially identical to locking mechanisms 24 of garment hanger management device 12. Various components of end cap assemblies 124 that correspond to substantially similar components of locking mechanisms 24 are given like numerals by the addition of 100, such that the components of end cap assemblies 124 may be understood with reference to the above discussion of locking mechanisms 24, while certain aspects that are unique to storage device 112 with end cap assemblies 124 are described in more detail below.

Figure 13:
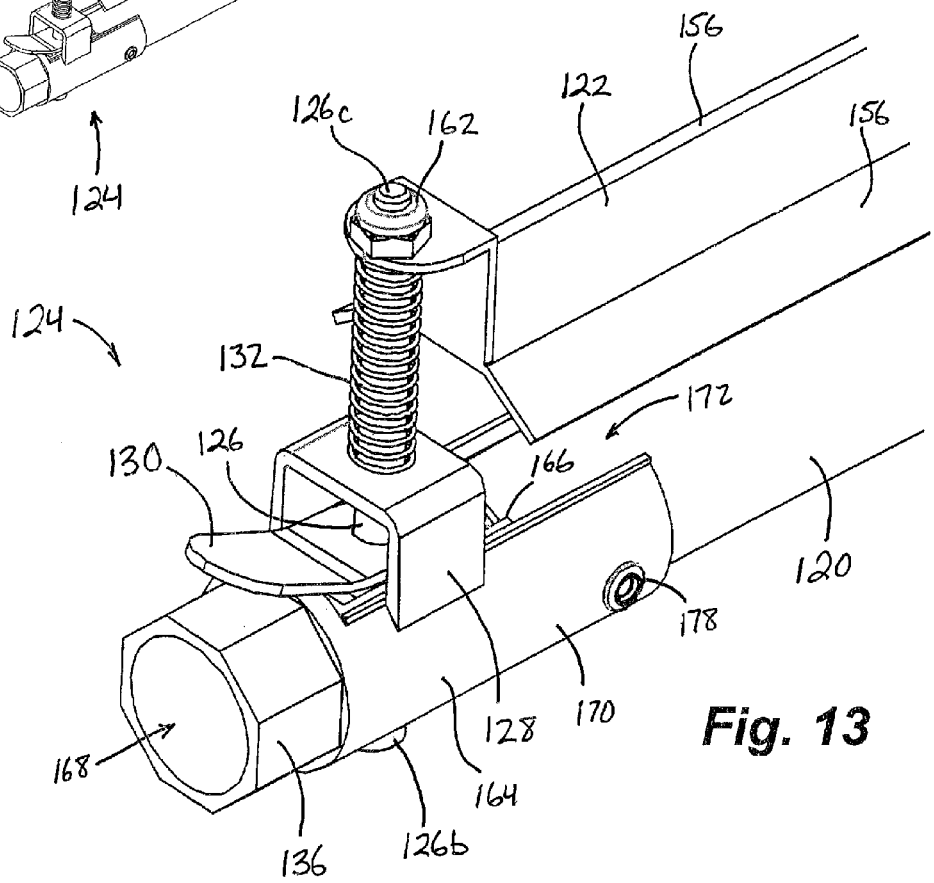
FIG. 13 is an enlarged perspective view of an end region of the garment hanger device of FIG. 12.
Figure 14:
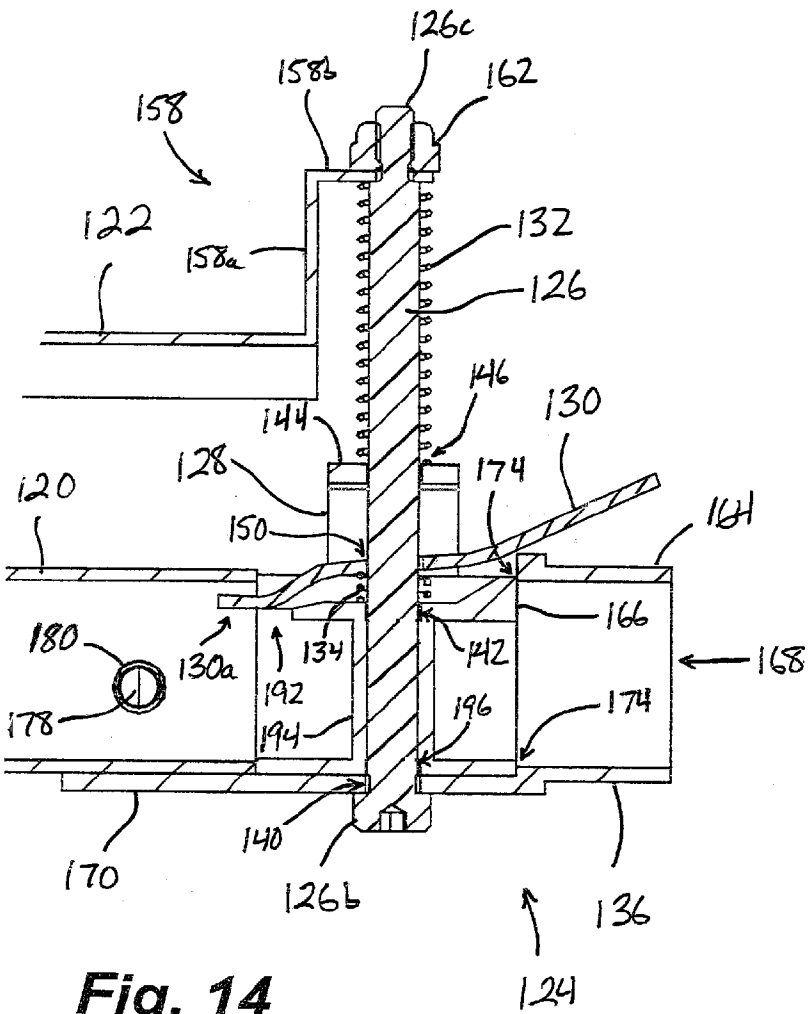
FIG. 14 is a side sectional elevation of another end region of the garment hanger device of FIG. 12 with the locking tab in the depressed, disengaged position, and taken along line XIV-XIV in FIG. 17.
Figure 17:
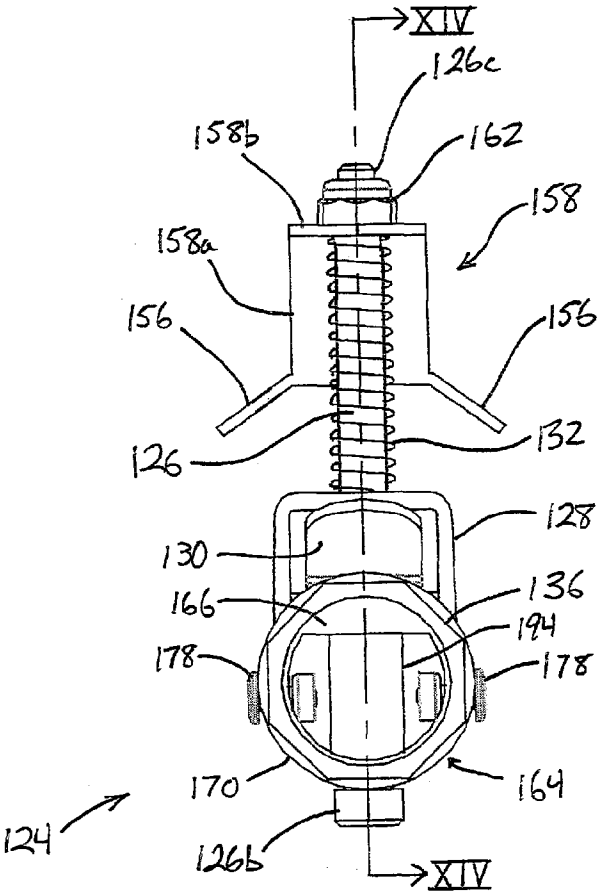
FIG. 17 is an end elevation of the end region of the garment hanger device of FIG. 12.

Referring to FIGS. 13-20, each end cap assembly 124 is generally cylindrical in shape and includes an end cap main body 164 and an end cap insert 166 that is received in a passageway 168 (FIG. 14) of the main body 164. Main body 164 has an anti-rotation feature in the form of an octagonal end portion 136, and an outer sleeve portion 170. Together, octagonal end portion 136 and outer sleeve portion 170 cooperate to define passageway 168. Outer sleeve portion 170 further defines an open slot 172 along its upper end (FIGS. 13 and 18), and is configured to substantially surrounds an end of hanger support rod 120. Slot 172 receives an upper portion of end cap insert 166, as best shown in FIGS. 13 and 14, and increases the flexibility of outer sleeve portion 170 to facilitate assembly of end cap assembly 124 onto hanger support rod 120 and insertion of end cap insert 166 into passageway 168. End cap main body 164 further defines an internal shoulder or lip 174 (FIG. 14) near the interface of sleeve portion 170 and octagonal end portion 136. Internal shoulder 174 has a diameter that is less than the diameter of end cap insert 166, so that end cap insert 166 is prevented from entering the portion of passageway 168 defined by octagonal end portion 136.

End cap main body 164 further includes a guide housing 128 extending upwardly from sleeve portion 170 and forming a bridge over a portion of slot 172. A bore 176 (FIG. 18) in each side of sleeve portion 170 allows for insertion of a mechanical fastener 178, such as a threaded bolt or screw, or a rivet (FIGS. 13-15 and 17), which is retained in a corresponding bore 180 in hanger support rod 120 (FIG. 14) to permanently or semi-permanently mount end cap assembly 124 to hanger support rod 120. Optionally, sleeve portion 170 and hanger support rod 120 may include interlocking elements, such as snap-fit elements, that facilitate the secure attachment of end cap assembly 124 to hanger support rod 120 without need for separate mechanical fasteners. For example, the sleeve portion may have one or more projections that extend radially inwardly from an inner surface thereof, and that snap into corresponding depressions or apertures in the hanger support rod once the rod is fully inserted into the sleeve portion. Such projections could include ramped surfaces to facilitate initial insertion of the hanger support rod, causing the sleeve portion to deflect somewhat outwardly until the projections snap into locking engagement with the depressions or apertures in the hanger support rod.

Figure 16:
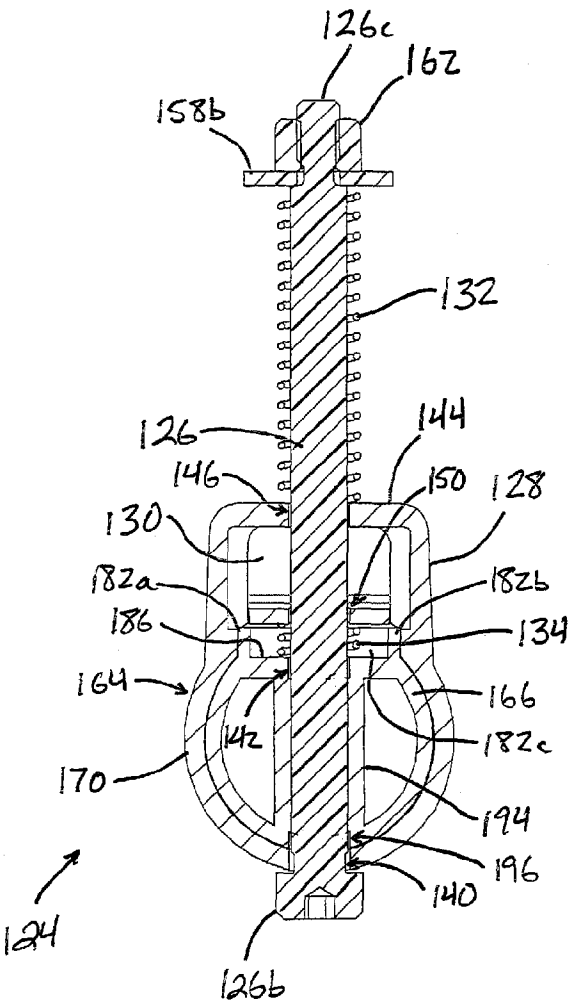
FIG. 16 is an end sectional elevation of the end region of the garment hanger device of FIG. 12, taken along line of XVI-XVI of FIG. 15.

End cap insert 166 has a generally cylindrical hollow body 166*a* with an upper portion 166*b* (FIGS. 19 and 20) that is shaped to be partially received in slot 172 of end cap main body 164 (FIGS. 13 and 16). The outer diameter of end cap insert 166 substantially corresponds to the inner diameter of sleeve portion 170 of main body 164, as best shown in FIG. 16. Upper portion 166*b* includes an upwardly-extending wall 182 that projects upwardly from cylindrical body 166*a*

Figure 19:
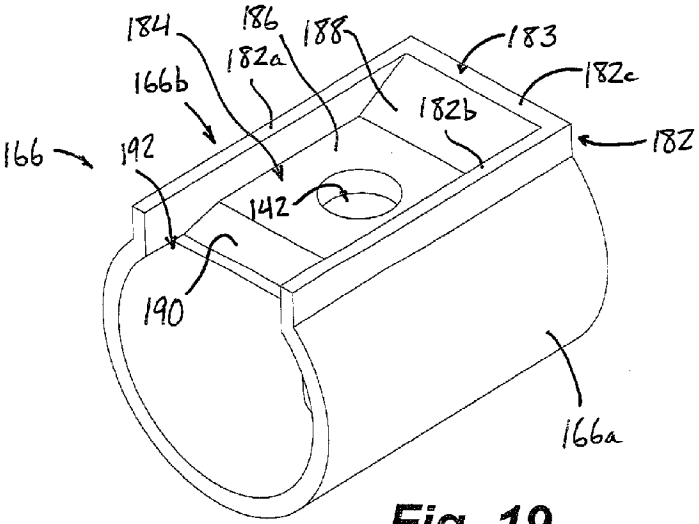
FIG. 19 is a perspective view of an end cap insert of the garment hanger device of FIG. 12.
Figure 20:
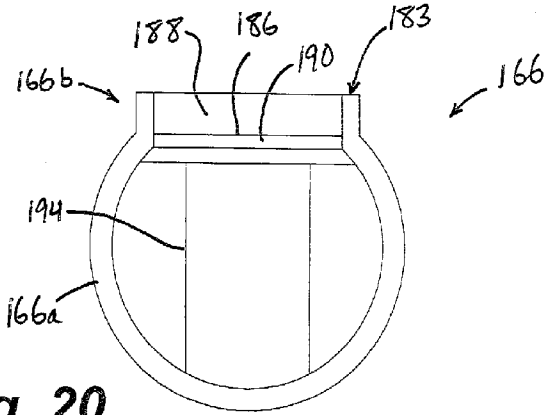
FIG. 20 is an end elevation view of the end cap insert of FIG. 19.
Figure 18:
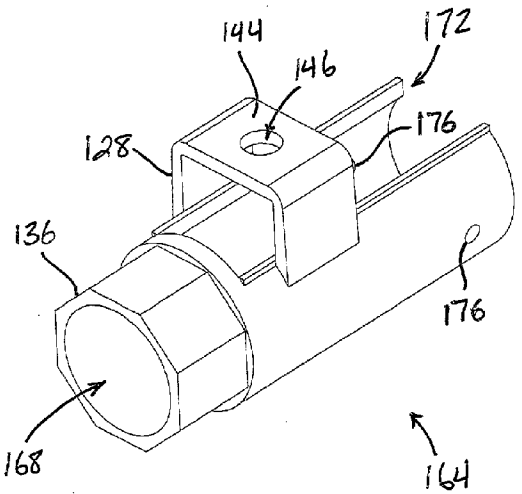
FIG. 18 is a perspective view of an end cap main body of the garment hanger device of FIG. 12.

(FIGS. 13, 16, 19, and 20). Wall 182 includes a pair of spaced, longitudinally-aligned legs 182*a*, 182*b* that extend along the entire length of end cap insert 166, with a lateral leg 182*c* extending between ends of longitudinally-aligned legs 182*a*, 182*b* to form a squared-off U-shape or C-shape when viewed from above. Legs 182*a-c* cooperate to form a substantially planar upper surface 183 (FIG. 19). Lateral leg 182*c* abuts or is adjacent an end of slot 172 at shoulder 174 (FIG. 14).

As best shown in FIG. 19, an upper surface 184 spans between the longitudinally-aligned legs 182*a*, 182*b* at upper portion 166*b* of end cap insert 166. Upper surface 184 includes a generally horizontal planar surface 186 defining a transverse aperture 142 for receiving and guiding a movable mounting member in the form of a movable pin 126. Horizontal planar surface 186 is spaced below the planar upper surface of wall 182 to provide space for a second biasing member 134 between wall 182 and a locking tab 130 (FIGS. 14 and 16). A first biasing member 132 is disposed along movable pin 126, between a generally planar portion 144 of guide housing 128 and a horizontal leg 158*b* of an L-shaped mounting portion 158 of retainer element 122.

Upper surface 184 further includes a ramped surface 188 between horizontal planar surface 186 and the upper surface of lateral leg 182*c* of wall 182, and another ramped surface 190 extending from horizontal planar surface 186 opposite ramped surface 188. Ramped surface 190 extends between longitudinally-aligned legs 182*a*, 182*b*, but does not extend longitudinally all the way to the end of legs 182*a*, 182*b*. Thus an open region 192 (FIGS. 14 and 19) is formed between an end of ramped surface 190 the end of end cap insert 166, which abuts or lies adjacent an end of hanger support rod 120, as shown in FIG. 14. Open region 192 accommodates locking tab 130 and permits a proximal end portion 130*a* of locking tab 130 to extend into the open end of hanger support rod 120.

Figure 15:
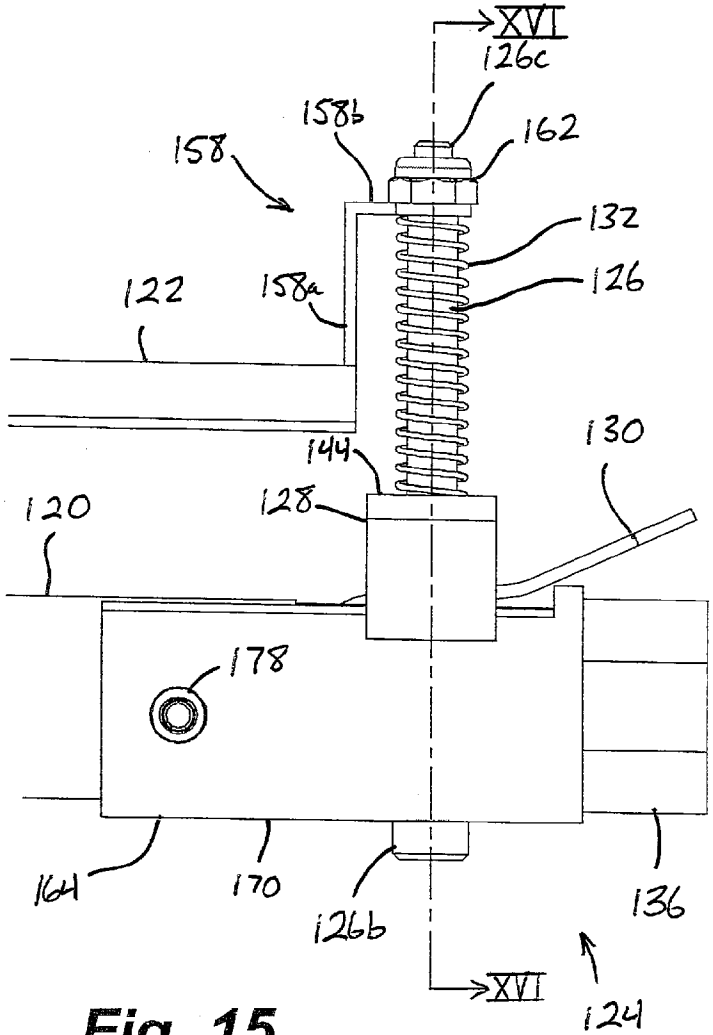
FIG. 15 is a side elevation of the end region of the garment hanger device of FIG. 12 with the locking tab in the depressed, disengaged position.

In FIGS. 14 and 15, locking tab 130 is shown in a depressed, disengaging position, generally corresponding to the depressed position of locking tab 30 in FIGS. 6A, 6B, and 10A, described above. Locking tab 130 is urged away from the depressed position of FIGS. 14 and 15 by second biasing member 134. In addition, when locking tab engages movable pin 126 with the pin in a less-than-fully-extended position, first biasing member 132 also urges locking tab 130 away from the depressed position, to thereby maintain an engaged position, by virtue of the engagement of locking tab 130 with movable pin 126. Thus, with locking tab 130 in the engaged position, it may be pivoted against the biasing force of second biasing member 134 (and, in some cases, against the biasing force of first biasing member 132) to disengage movable pin 126, which allows the pin to extend so that retainer element 122 reaches the fully open position of FIGS. 14-17.

End cap insert 166 further includes a substantially vertical tubular portion 194 that extends between horizontal planar surface 186 and a bottom portion of the cylindrical body 166*a* to form an open-ended sleeve around movable pin 126 (FIG. 16). Cylindrical body 166*a* forms a lower transverse aperture or bore 196 at the lower end of tubular portion 194, which is aligned with a first transverse aperture 140 in the bottom portion of sleeve portion 170 of end cap main body 164. The lower aperture 196 is also aligned with transverse apertures 150, 146, 142 so that movable pin 126 extends through each of apertures 140, 142, 146, 150, 196, as best shown in FIGS. 14 and 16.

End cap assembly 124 may be completely assembled or only partially assembled prior to attaching it to an end portion of hanger support rod 120 and attaching retainer element 122. Pre-assembly is generally accomplished by first inserting end cap insert 166 into passageway 168 of end cap main body 164 until insert 166 abuts shoulder 174 of main body 164, and then inserting movable pin 126 upwardly and sequentially through aperture 140 of sleeve portion 170, aperture 196 of end cap insert 166, vertical tubular portion 194 of end cap insert 166, aperture 142 of end cap insert 166, second biasing member 134, aperture 150 of locking tab 130, and first biasing member 132. Sleeve portion 170 may then be pushed onto the end portion of hanger support rod 120 until the end of rod 120 abuts end cap insert 166 and bores 176 of sleeve portion 170 align with bores 180 of rod 120. Rivets or other mechanical fasteners 178 may then be inserted through respective bores 176, 180 to retain end cap assembly 124 on hanger support rod 120. Once end cap assemblies 124 are attached to hanger support rod 120, pin-receiving apertures 160 of retainer element 122 may be placed over threaded stud portions 126*c* of respective movable pins 126 and threaded fasteners 162 attached to stud portions 126*c* to couple retainer element 122 to end cap assemblies 124.

It will be appreciated that the order of assembly can be varied significantly, without departing from the spirit and scope of the present invention. For example, once end cap main body 164 and insert 166 are assembled together, they may be coupled to hanger support rod 122, and the remaining components (e.g., locking tab 130, biasing members 132, 134, movable pin 126) that are a part of (or are associated with) end cap assembly 124 may be assembled in later steps.

As noted above, end cap assembly 124 provides substantially the same function as locking mechanism 24 of garment hanger storage device 12, such that the operation of end cap assembly 124 may be readily understood with reference to the above descriptions. End cap assembly 124 may provide cost savings for the manufacture of garment hanger storage device 112 as compared to garment hanger storage device 12. For example, end cap main body 164 and end cap insert 166 may be inexpensively formed from injection-molded plastic or other resinous material, assembled together without need for special tools or fixtures to maintain proper alignments, and coupled to an end of hanger support rod 120 (also without need for special tools or fixtures), thus avoiding potentially more costly metal forming and/or welding processes that may be involved in manufacturing the locking mechanisms 24 of device 12.

Thus, it will be appreciated that garment hanger management device provides secure and organized storage for a plurality of garment hangers regardless of the size of the hook portions of the garment hangers because the retainer element may be set at substantially any position relative to the hanger support rod, between a fully closed configuration and a fully open configuration. The device uses relatively few components and is relatively easy to assemble, such that the device is robust and economical to manufacture. The garment hanger management device thus provides for convenient and secure storage of garment hangers so that the hangers may be transported in organized fashion and readily removed from the hanger support rod in order to reuse the hangers.

Changes and modifications in the specifically described embodiments may be carried out without departing from the principles of the present invention, which is intended to be limited only by the scope of the appended claims, as interpreted according to the principles of patent law, including the doctrine of equivalents.

The invention claimed is:

1. A garment hanger management device for storing of a garment hanger having a hook portion, said device comprising:

an elongate hanger support rod for supporting at least one garment hanger at its hook portion, said hanger support rod having opposite end portions;

an elongate retainer element coupled to said hanger support rod, said retainer element being positionable between at least an open configuration and a closed configuration, wherein when in the open configuration said retainer element is spaced from said hanger support rod to permit placement and removal of the hook portion of the garment hanger from said hanger support rod and when in the closed configuration said retainer element is in close proximity to said hanger support rod to inhibit removal of the garment hanger from said hanger support rod;

at least one movable mounting member movably mounted on at least one of said opposite end portions of said hanger support rod, said mounting member being coupled to said retainer element and movable therewith;

a first biasing member configured to urge a distal end portion of said movable mounting member outwardly away from said hanger support rod in a transverse direction; and a locking tab pivotally coupled to at least one of said opposite end portions of said hanger support rod, said locking tab defining an aperture in which said movable mounting member is disposed, wherein said locking tab is configured to engage said movable mounting member at said aperture when said locking tab is in a first pivotal orientation, said locking tab configured to disengage said movable mounting member when said locking tab is in a second pivotal orientation, and wherein when in said first pivotal orientation, said locking tab substantially prevents said movable mounting member and said retainer element from moving toward the open configuration.

2. The garment hanger management device of claim 1, wherein said locking tab is configured to selectively engage said at least one movable mounting member at any of three or more positions along said movable mounting member.

3. The garment hanger management device of claim 2, wherein said aperture comprises a generally circular hole for receiving said at least one movable mounting member.

4. The garment hanger management device of claim 1, wherein said movable mounting member comprises a generally cylindrical pin.

5. The garment hanger management device of claim 4, wherein said aperture in said locking tab comprises a generally circular hole for receiving said generally cylindrical pin, said circular hole of said locking tab having a diameter that is at least slightly greater than the diameter of said cylindrical pin so as to permit said cylindrical pin to move substantially unimpeded through said circular hole when said locking tab is in said second pivotal orientation, and so as to cause said locking tab to impinge on said cylindrical pin to impede movement of said cylindrical pin through said circular hole when said locking tab is in said first pivotal orientation.

6. The garment hanger management device of claim 1, wherein said hanger support rod comprises a hollow tubular member.

7. The garment hanger management device of claim 6, wherein said hollow tubular member comprises at least one transverse aperture configured to receive said movable mounting member.

8. A garment hanger management device for storing of a garment hanger having a hook portion, said device comprising:

an elongate hanger support rod for supporting at least one garment hanger at its hook portion, said hanger support rod comprising a hollow tubular member having opposite end portions;

an elongate retainer element coupled to said hanger support rod, said retainer element being positionable between at least an open configuration and a closed configuration, wherein when in the open configuration said retainer element is spaced from said hanger support rod to permit placement and removal of the hook portion of the garment hanger from said hanger support rod and when in the closed configuration said retainer element is in close proximity to said hanger support rod to inhibit removal of the garment hanger from said hanger support rod;

at least one movable mounting member movably mounted on at least one of said opposite end portions of said hanger support rod, said mounting member being coupled to said retainer element and movable therewith;

a first biasing member configured to urge a distal end portion of said movable mounting member outwardly away from said hanger support rod in a transverse direction;

a locking tab pivotally coupled to at least one of said opposite end portions of said hanger support rod, said locking tab configured to engage said movable mounting member when said locking tab is in a first pivotal orientation, said locking tab configured to disengage said movable mounting member when said locking tab is in a second pivotal orientation, and wherein when in said first pivotal orientation, said locking tab substantially prevents said movable mounting member and said retainer element from moving toward the open configuration;

wherein said hollow tubular member comprises at least one transverse aperture configured to receive said movable mounting member; and wherein said hanger support rod comprises a guide housing having a surface spaced radially outwardly from said hanger support rod proximate said at least one transverse aperture, said surface defining a housing transverse aperture generally aligned with said at least one transverse aperture of said hollow tubular member and receiving said movable mounting member.

9. The garment hanger management device of claim 8, wherein said locking tab is disposed between said surface of said guide housing and said hanger support rod, and wherein said aperture of said locking tab is generally aligned with said at least one transverse aperture in said hanger support rod and with said housing transverse aperture in said surface of said guide housing.

10. The garment hanger management device of claim 9, further comprising a second biasing member disposed between said locking tab and an outer surface of said hanger support rod, said second biasing member configured to urge said locking tab into said first pivotal orientation.

11. The garment hanger management device of claim 10, wherein said first biasing member is positioned radially outwardly of said guide housing.

12. The garment hanger management device of claim 11, wherein said retainer element is coupled to said movable mounting member at a distal end portion thereof, and wherein said first biasing member is held in compression between said retainer element and said guide housing.

13. The garment hanger management device of claim 12, wherein said first biasing member and said second biasing member comprise coil springs disposed around said movable mounting member.

14. The garment hanger management device of claim 1, wherein said hanger support rod comprises an end cap assembly for movably coupling said retainer element to said hanger support rod.

15. The garment hanger management device of claim 14, wherein said end cap assembly comprises at least one transverse aperture for receiving said movable mounting member.

16. A garment hanger management device for storing of a garment hanger having a hook portion, said device comprising:

an elongate hanger support rod for supporting at least one garment hanger at its hook portion, said hanger support rod having opposite end portions;

an elongate retainer element coupled to said hanger support rod, said retainer element being positionable between at least an open configuration and a closed configuration, wherein when in the open configuration said retainer element is spaced from said hanger support rod to permit placement and removal of the hook portion of the garment hanger from said hanger support rod and when in the closed configuration said retainer element is in close proximity to said hanger support rod to inhibit removal of the garment hanger from said hanger support rod;

at least one movable mounting member movably mounted on at least one of said opposite end portions of said hanger support rod, said mounting member being coupled to said retainer element and movable therewith;

said hanger support rod comprising an end cap assembly for movably coupling said retainer element to said hanger support rod, said end cap assembly comprising at least one transverse aperture for receiving said movable mounting member;

a first biasing member configured to urge a distal end portion of said movable mounting member outwardly away from said hanger support rod in a transverse direction;

a locking tab pivotally coupled to at least one of said opposite end portions of said hanger support rod, said locking tab configured to engage said movable mounting member when said locking tab is in a first pivotal orientation, said locking tab configured to disengage said movable mounting member when said locking tab is in a second pivotal orientation, and wherein when in said first pivotal orientation, said locking tab substantially prevents said movable mounting member and said retainer element from moving toward the open configuration; and wherein said end cap assembly comprises a guide housing having a surface spaced radially outwardly from said at least one transverse aperture, said surface defining a housing transverse aperture generally aligned with said at least one transverse aperture and receiving said movable mounting member.

17. The garment hanger management device of claim 16, wherein said locking tab is disposed between said surface of said guide housing and said end cap assembly, and wherein said aperture of said locking tab is generally aligned with said at least one transverse aperture in said end cap assembly and with said housing transverse aperture in said surface of said guide housing.

18. The garment hanger management device of claim 17, further comprising a second biasing member disposed between said locking tab and an outer surface of said end cap assembly, said second biasing member configured to urge said locking tab into said first pivotal orientation.

19. The garment hanger management device of claim 18, wherein said first biasing member is positioned radially outwardly of said guide housing.

20. The garment hanger management device of claim 19, wherein said retainer element is coupled to said movable mounting member at a distal end portion of said movable mounting member, and wherein said first biasing member is held in compression between said retainer element and said guide housing.

21. The garment hanger management device of claim 20, wherein said first biasing member and said second biasing member comprise coil springs disposed around said movable mounting member.

22. The garment hanger management device of claim 14, wherein said hanger support rod comprises a hollow tubular member, and wherein said end cap assembly comprises a male extension portion configured to be received in an end portion of said hollow tubular member.

23. The garment hanger management device of claim 14, wherein said end cap assembly comprises an anti-rotation element.

24. The garment hanger management device of claim 23, wherein said anti-rotation element comprises a polygonal shaped portion configured to engage a correspondingly-shaped bracket.

25. The garment hanger management device of claim 14, wherein said end cap assembly comprises a main body defining a passageway, and an insert disposed in said passageway of said main body.

26. The garment hanger management device of claim 25, wherein said main body is configured to receive one of said opposite end portions of said hanger support rod in said passageway.

27. The garment hanger management device of claim 25, wherein an opening is defined between a portion of said insert and a portion of one of said opposite end portions of said hanger support rod, and a portion of said locking tab extends through said opening.

28. The garment hanger management device of claim 1, wherein said locking tab comprises a distal end portion spaced from said hanger support rod, and wherein said locking tab is pivotable against said first biasing member to said second pivotal orientation via application of a force applied to said distal end portion of said locking tab.

29. The garment hanger management device of claim 1, wherein said locking tab permits said movable mounting member to be moved toward a closed configuration without direct manipulation of said locking tab.

30. A garment hanger management device for storing of a garment hanger having a hook portion, said device comprising:

an elongate hanger support rod for supporting at least one garment hanger at its hook portion, said hanger support rod having opposite end portions;

an elongate retainer element coupled to said hanger support rod, said retainer element being positionable between at least an open configuration and a closed configuration, wherein when in the open configuration said retainer element is spaced from said hanger support rod to permit placement and removal of the hook portion of the garment hanger from said hanger support rod and when in the closed configuration said retainer element is in close proximity to said hanger support rod to inhibit removal of the garment hanger from said hanger support rod;

at least one movable mounting member mounted to at least one of said opposite end portions of said hanger support rod, said mounting member having opposite end portions, at least one of said opposite end portions of said mounting member being spaced transversely outwardly from said hanger support rod and coupled to said elongate retainer element, said movable mounting member being movable with said retainer element between said open configuration and said closed configuration;

a first biasing member configured to urge said distal end portion of said movable mounting member outwardly away from said hanger support rod in a transverse direction; and a locking tab pivotally coupled to at least one of said opposite end portions of said hanger support rod, said locking tab defining an aperture in which said movable mounting member is disposed, wherein said locking tab is configured to engage said movable mounting member at said aperture when said locking tab is in a first pivotal orientation, said locking tab configured to disengage said movable mounting member when said locking tab is in a second pivotal orientation, and wherein when in said first pivotal orientation, said locking tab substantially prevents said movable mounting member and said retainer element from moving toward the open configuration.

31. A garment hanger management device for storing of a garment hanger having a hook portion, said device comprising:

an elongate hanger support rod for supporting at least one garment hanger at its hook portion, said hanger support rod having opposite end portions;

a pair of end cap assemblies, each coupled to a respective one of said opposite end portions of said hanger support rod and at least one of said end cap assembly including an anti-rotation element configured to engage a support bracket;

an elongate retainer element coupled to said hanger support rod via said end cap assemblies, said retainer element being positionable between at least an open configuration and a closed configuration, wherein when in the open configuration said retainer element is spaced from said hanger support rod to permit placement and removal of the garment hanger from said hanger support rod and when in the closed configuration said retainer element is in close proximity to said hanger support rod to inhibit removal of the garment hanger from said hanger support rod;

a pair of movable mounting members, each disposed at a respective one of said end cap assemblies;

a pair of first biasing members, each configured to urge a distal end portion of one of said movable mounting members outwardly away from said end cap assemblies in a transverse direction; and a pair of locking tabs, each pivotally coupled to a respective one of said end cap assemblies, said locking tabs each defining an aperture in which said movable mounting members are disposed, wherein said locking tabs are configured to engage a respective one of said movable mounting members at said apertures when said locking tabs are in a first pivotal orientation, said locking tabs configured to disengage said movable mounting members when said locking tabs are in a second pivotal orientation, and wherein when in said first pivotal orientation, said locking tabs substantially prevent said movable mounting members from moving toward the open configuration.

32. A garment hanger management device for storing of a garment hanger having a hook portion, said device comprising:

an elongate hanger support rod for supporting at least one garment hanger at its hook portion, said hanger support rod having opposite end portions;

a pair of end cap assemblies, each coupled to a respective one of said opposite end portions of said hanger support rod and at least one of said end cap assembly including an anti-rotation element configured to engage a support bracket;

an elongate retainer element coupled to said hanger support rod via said end cap assemblies, said retainer element being positionable between at least an open configuration and a closed configuration, wherein when in the open configuration said retainer element is spaced from said hanger support rod to permit placement and removal of the garment hanger from said hanger support rod and when in the closed configuration said retainer element is in close proximity to said hanger support rod to inhibit removal of the garment hanger from said hanger support rod;

a pair of movable mounting members, each disposed at a respective one of said end cap assemblies;

a pair of first biasing members, each configured to urge a distal end portion of one of said movable mounting members outwardly away from said end cap assemblies in a transverse direction;

a pair of locking tabs, each pivotally coupled to a respective one of said end cap assemblies, said locking tabs configured to engage a respective one of said movable mounting members when said locking tabs are in a first pivotal orientation, said locking tabs configured to disengage said movable mounting members when said locking tabs are in a second pivotal orientation, and wherein when in said first pivotal orientation, said locking tabs substantially prevent said movable mounting members from moving toward the open configuration; and wherein each of said end cap assemblies comprises at least one transverse aperture for receiving said movable mounting member, each of said end cap assemblies further comprising a guide housing having a surface spaced radially outwardly from said at least one transverse aperture, said surface defining a housing transverse aperture generally aligned with said at least one transverse aperture for receiving said movable mounting member.

33. The garment hanger management device of claim 32, wherein each of said locking tabs comprises an aperture generally aligned with said housing transverse aperture and said at least one transverse aperture, and wherein each of said locking tabs is disposed between a respective one of said surfaces of said guide housings and an outer surface of said end cap assemblies.

34. The garment hanger management device of claim 33, further comprising a pair of second biasing members, each disposed between a respective one of said locking tabs and said outer surface of said end cap assembly, said second biasing member configured to urge said locking tab into said first pivotal orientation, and wherein first biasing members are positioned radially outwardly of respective ones of said guide housings. said guide housings.

* * * * *

UNITED STATES PATENT AND TRADEMARK OFFICE

CERTIFICATE OF CORRECTION

PATENT NO. : 8,387,808 B2
APPLICATION NO. : 12/951782
DATED : March 5, 2013
INVENTOR(S) : James A. Radowski It is certified that error appears in the above-identified patent and that said Letters Patent is hereby corrected as shown below:

In the Claims:

Column 20
Claim 34, Line 65, Delete "said guide housings." after "said guide housings."

Signed and Sealed this
Fifteenth Day of July, 2014

Michelle K. Lee

Michelle K. Lee
*Deputy Director of the United States Patent and Trademark Office*